US006470161B2

(12) United States Patent
Fujishiro et al.

(10) Patent No.: US 6,470,161 B2
(45) Date of Patent: Oct. 22, 2002

(54) APPARATUS FOR MINIMIZING TONER CONTAMINATION ON AN IMAGE FORMATION MEMBER

(75) Inventors: Takatsugu Fujishiro, Tokyo; Masami Hiramatsu; Masumi Sato, both of Yokohama; Hitoshi Ishibashi, Kamakura; Hiroshi Yosinaga, Ichikawa; Yukiko Iwasaki, Yokohama, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/826,813

(22) Filed: Apr. 6, 2001

(65) Prior Publication Data

US 2001/0053298 A1 Dec. 20, 2001

(30) Foreign Application Priority Data

Apr. 7, 2000 (JP) ..... 2000-106146
Apr. 28, 2000 (JP) ..... 2000-130049

(51) Int. Cl.[7] ..... G03G 15/00; G03G 15/02
(52) U.S. Cl. ..... 399/159; 399/115; 399/174; 399/176
(58) Field of Search ..... 399/115, 159, 399/160, 174, 175, 176

(56) References Cited

U.S. PATENT DOCUMENTS

| | | | | |
|---|---|---|---|---|
| 5,799,229 A | * | 8/1998 | Yokoyama et al. | 399/100 |
| 5,946,529 A | | 8/1999 | Sato et al. | |
| 6,088,551 A | | 7/2000 | Satoh et al. | |

FOREIGN PATENT DOCUMENTS

| | | |
|---|---|---|
| JP | 3-240076 | 10/1991 |
| JP | 4-360167 | 12/1992 |
| JP | 6-230650 | 8/1994 |
| JP | 7-121002 | 5/1995 |
| JP | 9-26685 | 1/1997 |
| JP | 9-138623 | 5/1997 |
| JP | 10-340028 | 12/1998 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

To prevent deterioration of charge performance, which is caused by wear of a gap control member that keeps a charge roller into non-contact with the image carrier, the charge roller is brought into contact with a surface of a photosensitive drum via a pair of tape members as the gap control member that contacts with a coat and non-charge portion of the photosensitive drum. A gap G can be formed between an effective charge width portion of the charge roller and the surface of the photosensitive drum.

26 Claims, 21 Drawing Sheets

FIG. 19

| | OVERLAY SECTION | | | NON OVERLAY SECTION | | |
|---|---|---|---|---|---|---|
| | FIRST TIME | SECOND TIME | THIRD TIME | FIRST TIME | SECOND TIME | THIRD TIME |
| SMALL NUMBER | ◎ | ◎ | ◎ | ◎ | ◎ | ◎ |
| 10K | ○ | ○ | ○ | ○ | ○ | ○ |
| 20K | ○ | ○ | ○ | ○ | ▲ | ○ |
| 50K | ○ | ○ | ○ | △ | × | △ |
| 100K | ○ | ○ | ○ | △ | — | △ |

APPARATUS FOR MINIMIZING TONER CONTAMINATION ON AN IMAGE FORMATION MEMBER

CROSS REFERRENCE TO RELATED APPLICATIONS

This application claims priority under 35 USC §119 to Japanese Patent Applications Nos. 2000-130049 and 2000-106146, filed on Apr. 28, and Apr. 7, both 2000, the entire contents of which are herein incorporated by reference.

BACKGROUND OF THE INVENTION

1. Field of the Invention

The present invention relates to an image forming apparatus, such as a copier, a printer, a facsimile, etc., and in particular related to a charge member that contacts a surface of a photosensitive member and is capable of keeping high charge performance while preventing wear of a gap control mechanism disposed between the charge member and the photosensitive member.

2. Discussion of the Background

There is conventionally available a non-contact type charge unit based on a process of arranging the portion of the effective charge width of the charge member close to the surface of a photosensitive body serving as an image carrier and charging the surface of the photosensitive body by impressing a voltage between the charge member and the photosensitive body. This charge unit provides an advantage of being resistant to contamination because the effective charge width portion of the charge member does not come into contact with the surface of the photosensitive body. In a charge unit of this non-contact type, the portion of the charge roller other than the both ends is prevented from coming into contact with the surface of the photosensitive body serving as an image carrier by forming projections at both ends of the roller portion of the charge roller serving as a charge member through attachment of a tape member. An example of the charge roller is illustrated in FIG. 14. This charge roller 114 is formed by, for example, providing a conductive elastic portion 117 on the outer periphery of a core 116 made of stainless steel, and integrally fixing the same by winding resin tape members 118 and 118 in the circumferential direction on the both ends of the elastic portion 117.

The both ends of the core 116 are pressed with a prescribed pressing force against the photosensitive drum 105 via plain bearings 130 and 130 by means of pressing springs 119 and 119. In the charge roller 114, therefore, the tape members 118 and 118 come into contact with the surface of the photosensitive drum 105, and the effective charge width (Wac) of the elastic portion 117 prevented from being in contact with the surface of the photosensitive drum 105 (a gap G corresponding to the thickness of the tape member is formed).

However, the non-contact type charge unit, in which a prescribed gap is formed in the effective charge width between the charge roller thereof and the surface of the photosensitive drum by integrally fixing a tape member having a prescribed thickness at both ends of the charge roller, and bringing the tape member portion into contact with the photosensitive drum, has a problem of wear of the tape member.

More specifically, the gap G shown in FIG. 14 should have a size of, for example, about 100 $\mu$m, or smaller than 100 $\mu$m, since an excessively wide gap makes it impossible to obtain a prescribed charge performance. As a result, the tape member has a very small thickness of about 100 $\mu$m. However, because the tape member continues rotating while the outer peripheral surface is in contact with the surface of the photosensitive drum, it is inevitable that the outer peripheral surface thereof is worn out with the lapse of time.

When the tape member prematurely is worn out, the charge roller comes into contact with the surface of the photosensitive drum at the portion of the effective charge width (a gap of null). In this state, residual toner on the photosensitive drum moves onto the portion of the effective charge width of the charge roller, and contamination thereof often results in defective charging.

On the other hand, even when the charge roller is prevented from coming into contact with the photosensitive body in the image forming area, the surfaces of the charge roller and the photosensitive body have fine concave and convex portions as represented by a straightness unavoidable in the axial direction in terms of processing accuracy (a value represented by the height from the bottom of a concave portion to the top of the convex portion; flatness when the object is flat). The charge roller and the photosensitive body may therefore be in contact with each other, depending upon the degree of straightness (or flatness).

Under these circumstances, even in a non-contact charge unit, when most part of the surface of the charge roller comes into contact with the surface of the image carrier, contamination adhering to the surface of the image carrier moves to the surface of the charge roller, thus deteriorating charge performance.

SUMMARY OF THE INVENTION

Accordingly, an object of the present invention is to address and resolve the above and other problems and provide a new image processing apparatus. The above and other objects are achieved according to the present invention by providing a novel image forming apparatus that may include a coated portion that forms a photosensitive layer, an image carrier that has a non-coated portions formed of a material harder than the coated portion on the both sides thereof, and a charge member that charges the coated portion of the image carrier. In addition, the charge member may be brought into contact with the surface of the image carrier via a gap control member in contact with a non-charged area of the coated portion of the image carrier to form a prescribed gap between a portion corresponding to an effective charge width of the charge member and the surface of the image carrier.

In another embodiment, a cleaning member may be provided to clean over a prescribed cleaning width by coming into sliding contact with the coated portion of the image carrier, and the gap control member may be positioned within the cleaning width of the cleaning member. The cleaning width may be outside or inside an outer end of the gap control member.

In yet another embodiment, a cleaning member oscillation mechanism may be provided to oscillate the cleaning member in a direction perpendicular to the sliding contact direction relative to the image carrier, and a cleaning oscillation area width of the cleaning member may be used as the cleaning width.

In yet another embodiment, the cleaning device may be provided to clean the coated portion by bringing a cleaning blade into sliding contact with the coated portion of the image carrier.

In yet another embodiment, a transfer member transferring a visible image formed on the surface of the image carrier may be provided, and an effective transfer width thereof may be narrower than the effective charge width of the charge member. In yet another embodiment, a development unit may be provided to develop a latent image on the image carrier with a developer into a visible image and the developing width is smaller than the effective charge width of the charge member.

In yet another embodiment, the development width may be smaller than the effective transfer width.

In yet another embodiment, the image forming apparatus may use a two-component developer using a toner and a carrier.

In yet another embodiment, the cleaning width may be wider than the effective charge width.

In yet another embodiment, a cleaning member oscillation mechanism may be provided to oscillate the cleaning member in a direction perpendicular to the sliding contact direction of the cleaning member relative to the image carrier, and displacement limits on the cleaning member may be located at positions outside the effective charge width, respectively.

In yet another embodiment, the charge member may include a charge roller having a metal shaft and an elastic portion on a portion other than both ends of its outer peripheral surface, and the gap control member may include a pair of tape members fixed to the both ends of the elastic portion, respectively. In addition, the width between insides of the pair of tape members may serve as the effective charge width. The tape member may be formed to have a thickness of up to 100 $\mu$m.

In yet another embodiment, the pair of tape members may be wound and fixed to the both ends of the elastic portion in the circumferential direction, respectively in such a manner that there is no portion, in the roller axial direction, where the tape members are not present for all positions over the entire circumference without the both ends in the circumferential direction overlap.

In yet another embodiment, the inclination angle between the cut line of the both diagonally cut ends of the pair of tape members relative to the side edge of the tape members may substantially be 45°.

In yet another embodiment, the charge roller may have the both ends of the metal shaft spaced apart from the non-coated portion at positions where no leakage is caused from the both ends of the metal shaft to the non-coated portion of the image carrier when voltage is impressed between the metal shaft and the image carrier.

In yet another embodiment, the charge member may include a charge roller having of the metal shaft and an elastic portion at a portion other than the both ends of its outer periphery, and the gap control member may include a pair of rollers attached to the both ends of the metal shaft.

In yet another embodiment, an image carrier unit may provided to integrally mount the image carrier and the charge member.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 19 is a table illustrating a result of a wear test performed both of when a tape contacts a chat portion of the photosensitive member and a non-coat portions thereof.

DETAILED DESCRIPTION OF THE PREFERRED EMBODIMENTS

Figure 1:
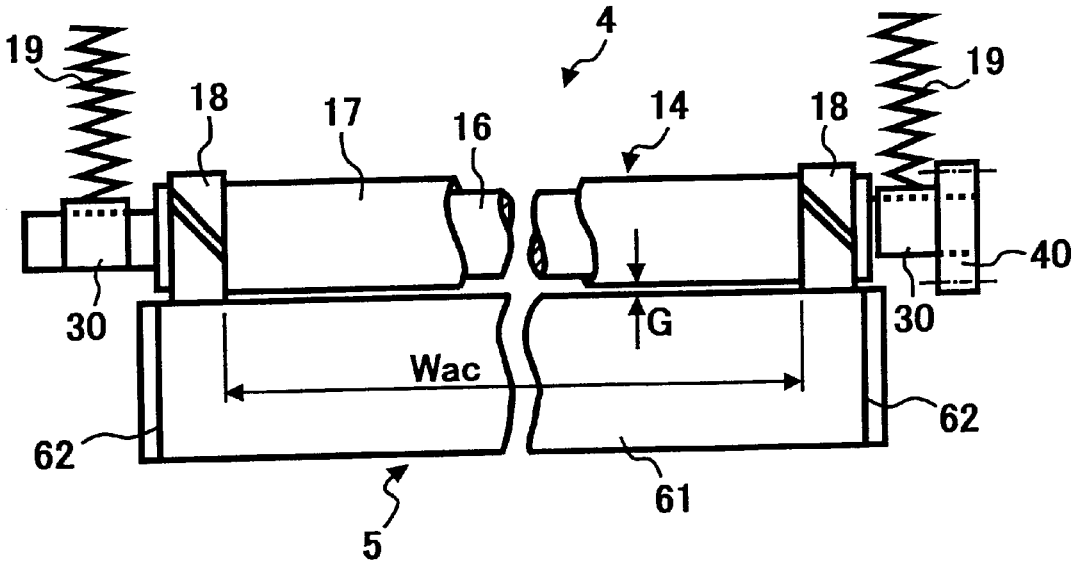
FIG. 1 is a schematic view illustrating one embodiment of an image forming apparatus including a charge roller and a photosensitive drum according to the present invention.

Embodiments of the present invention will now be described with reference to the drawings, wherein like reference numerals and marks designate identical or corresponding parts throughout several views.

FIG. 1 is a schematic view illustrating a charge roller and a photosensitive drum mounted on an image forming apparatus serving as an embodiment of the invention.

Figure 2:
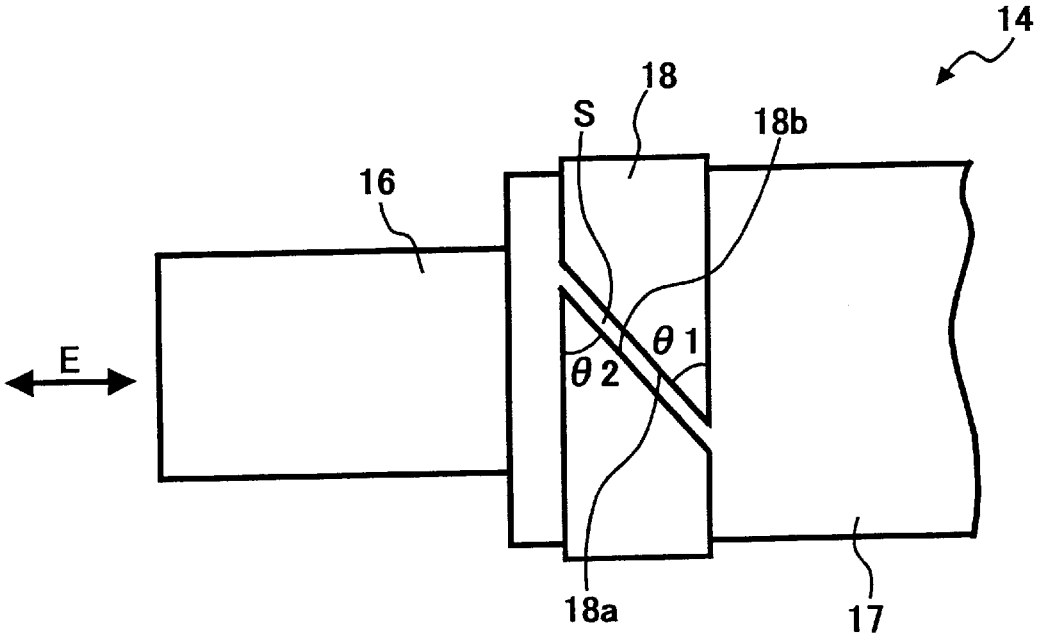
FIG. 2 is an enlarged view illustrating one of the ends of the charge roller shown in FIG. 1.
Figure 3:
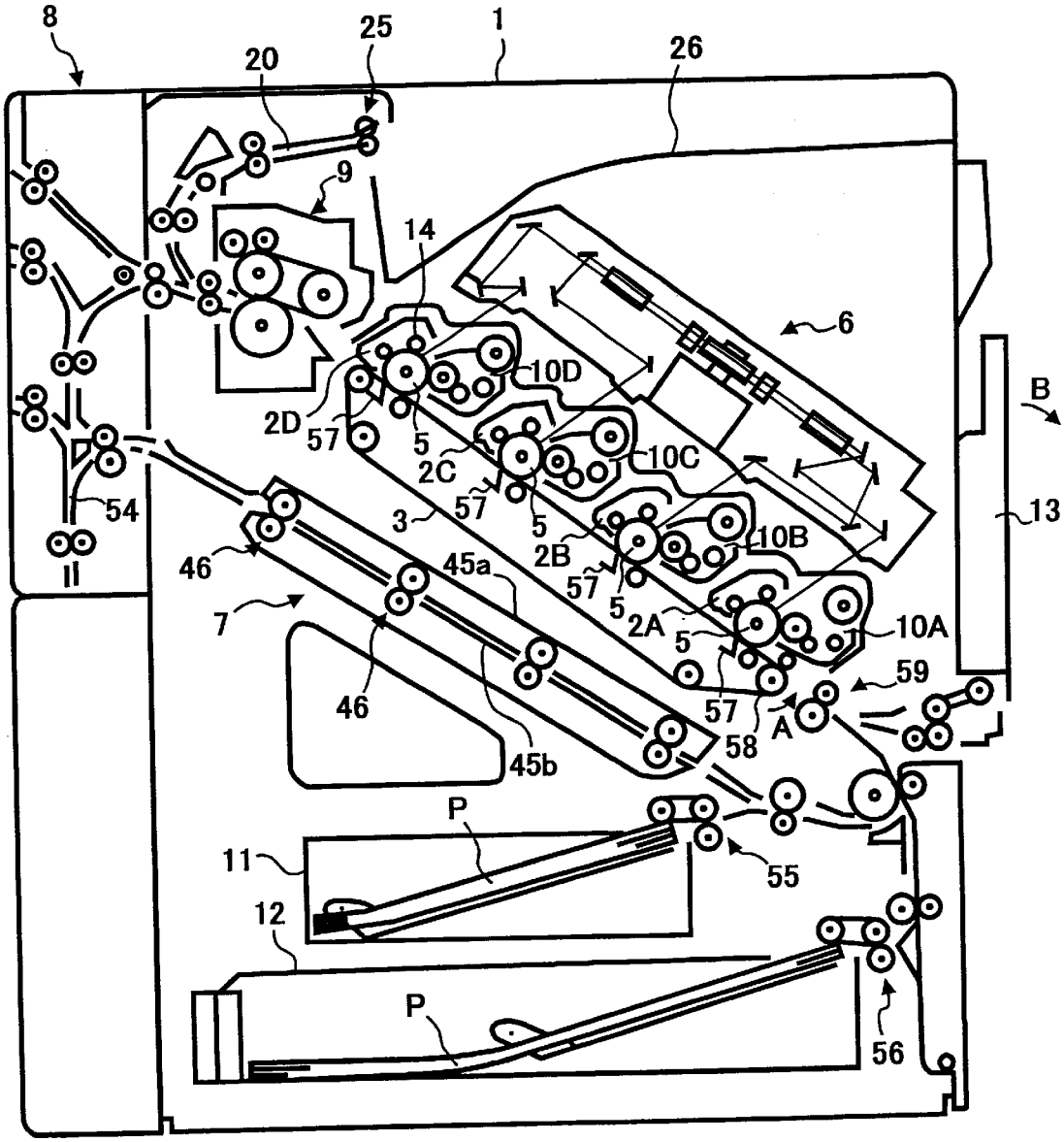
FIG. 3 is a whole configuration diagram illustrating a compact color printer as an image forming apparatus.

FIG. 2 is an enlarged view showing in an enlarged scale an end side of the same charge roller. FIG. 3 is a whole configuration diagram illustrating a compact color printer, as an image forming apparatus.

The compact color printer, which is the image forming apparatus shown in FIG. 3, is a four-drum full-color electrophotographic image forming apparatus. Four photosensitive units 2A, 2B, 2C and 2D, which are four image carriers, are detachably attached in an apparatus main body 1. This compact printer stretches a transfer belt 3 between a plurality of rollers in the arrow A direction substantially at the center in the apparatus main body 1.

The photosensitive units 2A, 2B, 2C and 2D are arranged so that photosensitive drums 5 provided on the four individual photosensitive units 2A to 2D come into contact with the upper surface in FIG. 3 of the transfer belt 3. Developing units 10A to 10D for different toner colors corresponding to the photosensitive units 2A to 2D are arranged.

A write unit 6 is arranged above the photosensitive units 2A to 2D, and a duplex unit 7 is arranged therebelow. A reversing unit 8 reversing and discharging a transfer sheet of paper P after forming an image, and sending the same to the duplex unit 7 is mounted on this compact printer to the left of the apparatus main body 1 in FIG. 3.

A fixing unit 9 fixing the image on the transfer paper onto which the image has been transferred is provided between the transfer belt 3 and the reversing unit 8. A reversal conveying path 20 is branched in the downstream of the fixing unit 9 in the transfer paper conveying direction so as to make it possible to discharge the conveyed transfer paper P onto a paper discharge tray 26 by means of a paper discharge roller pair 25.

A plurality of paper feed cassettes 11 and 12 capable of housing transfer sheets of paper P having different sizes are arranged in two upper and lower stages in the lower part of the apparatus main body 1 interior. On the right side surface of the apparatus main body 1, furthermore, a hand-feed tray 13 is provided so as to be capable of being opened/closed in the arrow B direction so that hand feed can be conducted therefrom by releasing the hand-feed tray 13.

The photosensitive units 2A to 2D have uniform configurations. The photosensitive unit 2A forms an image corresponding to yellow color. The photosensitive unit 2B forms an image corresponding to magenta color. The photosensitive unit 2C forms an image corresponding to cyan color. The photosensitive unit 2D forms an image corresponding to black color. The photosensitive units are arranged at intervals in the conveying direction of the transfer paper.

Figure 4:
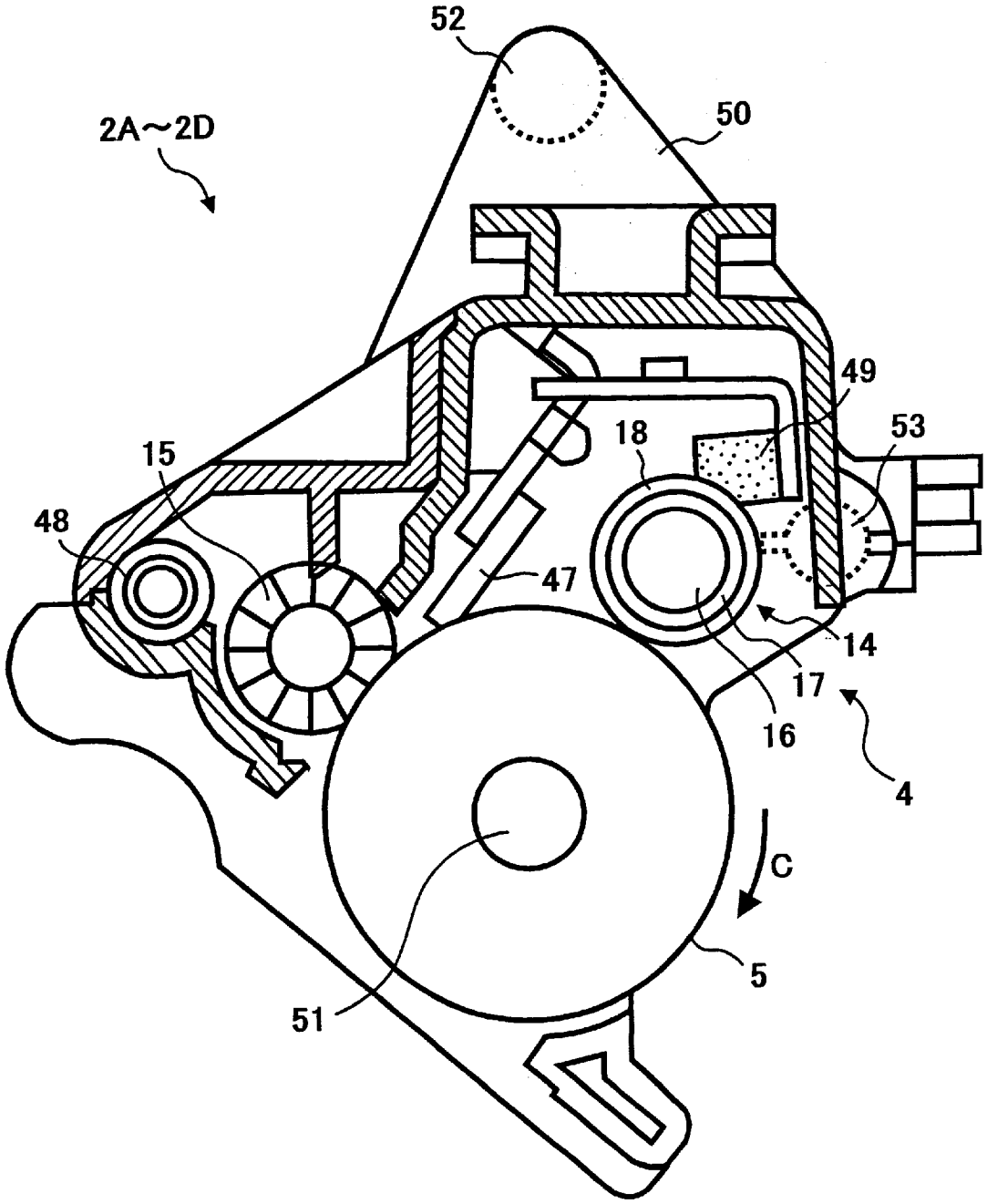
FIG. 4 is a configuration diagram illustrating a photosensitive unit of the aforementioned compact printer.

Each of the photosensitive units 2A to 2D is built into an integral unit comprising a charge roller 14 of a charge unit serving as charging member, a photosensitive drum 5, which is an OPC drum type image carrier, having a surface charged by a charge roller 14, on which an electrostatic latent image is formed through exposure, and a cleaning blade 47 and a brush roller 15 collectively forming a cleaning unit (cleaning means) cleaning the surface of the photosensitive drum 5, as shown in FIG. 4, and is made detachable from the apparatus main body 1 shown in FIG. 3.

The charge unit 4 arranges an effective charge width (Wac) portion of the charge roller 14 serving as a charge member in the vicinity of a charge receiving surface of the photosensitive drum 5 as shown in FIG. 1 using the later described construction, and charges the surface of the photosensitive drum 5 by impressing a voltage between the charge roller 14 and the photosensitive drum 5.

The charge roller 14 of the charge unit 4 is made by forming a conductive rubber roller section 17, serving as an elastic portion, including a material such as epichlorohydrin rubber and having a volume intrinsic resistivity value of $1\times10^3$ to $1\times10^8$ Ω·cm on a portion of a core 16 outer peripheral surface other than the both ends, which is an axial shaft formed by SUM-Ni plating (nickel-plating-finished).

A plurality of tape members 18 and 18 that serves as gap control members each including an adhesive sheet having an adhesive surface on its one side, and made of, for example, polyester, polyethylene, terephthalate, PET, PI, preferably PP, are wound in the circumferential direction with the adhesive surface downward onto the both ends of the conductive rubber roller 17. Such a plastic sheet may have thickness of 40 μm. The adhesive sheet may have thickness of 20 m. Thus, the tape may have thickness of a total 60 μm.

As shown in FIG. 2 illustrating one of the tape members 18, the tape members 18 and 18 on the both sides are fixed by pasting the adhesive surfaces so that the end edges 18*a* and 18*b* on the both sides serving as the both ends in the circumferential direction do not overlap each other, and there is not tape member 18 in the axial direction of the roller in the arrow E direction for all positions over the entire circumference.

For this purpose, as shown in FIG. 2, the both ends of the tape members 18 are diagonally cut so that the end edges 18*a* and 18*b* of the resultant cut ends face each other, and a gap (S) is formed between the cut end edges 18*a* and 18*b*. The end edges 18*a* and 18*b* forming the cut lines of the diagonally cut ends of the pair of tape members 18 and 18 have inclination angles $\theta_1$ and $\theta_2$ of about 45° to the side edges of the tape members 18.

By forming inclination angles $\theta_1$ and $\theta_2$ of the cut lines of the tape members 18 of about 45°, the leading ends in the winding direction of the tape members 18 can be made hardly susceptible to peeling. It is also possible to increase the contact width with the photosensitive drum at joints of the tape members 18 (where the gap (S) is formed). The adhesive force of the both leading ends to the elastic portion 17 therefore becomes larger as compared with acute inclination angles $\theta_1$ and $\theta_2$. It is therefore possible to make the both leading ends of the tape members 18 less susceptible to peeling.

The charge roller 14 forms, as shown in FIG. 4, a charge unit 4 charging the surface of the photosensitive drum 5 by bringing the tape members 18 and 18 at the both ends into contact with the photosensitive drum 5 and impressing a voltage from a power source (not shown) between the charge roller 14 and the photosensitive drum 5.

As shown in FIG. 1, the both ends of the core 16 of the charge roller 14 are pressed with a prescribed pressing force by pressing springs 19 and 19 against the photosensitive drum 5 via plain bearings 30 and 30. For the charge roller 14, the tape members 18 and 18 at the both ends may be brought into contact with the photosensitive drum 5 by gravity, without using pressing springs 19.

A driving gear 40 is fixed to an end of the core 16 to the right in FIG. 1. Driving force from a motor (not shown) is transmitted there so as to rotate the charge roller 14 at the same linear speed as that of the photosensitive drum 5. Impression of voltage onto the charge roller 14 is accomplished by impressing a voltage of about DC-700V to the core 16 portion under a constant voltage control, and impressing an AC voltage under a constant current control.

The charge roller 14 is built, for example, by forming the core 16 to have an outside diameter of about 9 mm, and forming the conductive rubber roller 17 comprising a rubber layer made of epichlorohydrin as described above with a thickness of about 1.5 mm. The tape member 18 wound onto the both ends of the conductive rubber roller 17 has, in this embodiment, a tape width of about 8 mm and a thickness of from about 25 to about 125 μm. With a tape member 18 thickness of under about 100 μm, a more stable charge performance can be available. A rubber having a hardness of about 77 degrees in former JIS-A (i.e., a test piece hardness of the rubber itself higher than 50 degrees) is used for the conductive rubber roller 17.

The photosensitive drum 5 is rotation-driven in the arrow C direction in FIG. 4 by a rotation-driving motor via a drum-driving timing belt and a drum-driving pulley (not shown). The photosensitive units 2A to 2D each having a photosensitive drum 5 each has a cleaning blade 47 which causes the leading ends to come into contact with the coated portion 61, described later, on the surface of the photosensitive drum 5 and conducts cleaning by scraping off residual toner remaining after transfer and the like adhering to the coated portion 61. Toner scraped off by the cleaning blade 47 is moved by a brush roller 15 onto the toner conveying auger 48, and the waste toner collected by rotating the toner conveying auger 48 is conveyed to a prescribed waste toner container.

In both of the photosensitive units 2A to 2D, a charge roller cleaner 49 comprising sponge or the like is brought into contact with the surface of the conductive rubber roller 17 of the charge roller 14 to make it possible to clean off toner or dust floating in the apparatus, adhering to the surface of the conductive rubber roller 17, if any.

For these photosensitive units 2A to 2D, a main positioning reference 51 is provided as a reference for attaching or detaching the photosensitive units 2A to 2D to or from the apparatus main body 1 (see FIG. 3). Furthermore, an outer positioning sub-reference 52 and an inner positioning sub-reference 53 are integrally provided with a bracket 50 so as to permit certain positioning of the photosensitive units 2A to 2D at prescribed mounting positions by means of these references upon mounting the photosensitive units 2A to 2D on the apparatus main body 1.

The photosensitive drums 5 of the photosensitive units 2A to 2D rotate in the arrow C direction, respectively, as described above. The linear speed of the photosensitive drums 5 can be adjusted to three stages of about 185 mm/sec, about 125 mm/sec, and about 62.5 mm/sec in accordance with several modes, such as a monochromatic speed preference mode, a monochromatic image quality preference mode, a color speed preference mode, a color image quality preference mode, a cardboard/OHP paper feed mode, etc. The photosensitive units may be configured with a charge roller 14 and a photosensitive drum 5 as an integral unit by excluding the brush roller 15 from the configuration.

A plurality of developing units 10A to 10D shown in FIG. 3 have a uniform configuration having only different colors of toner to be used. The developing unit 10A uses a yellow color toner. The developing unit 10B uses a magenta color toner. The developing unit 10C uses a cyan color toner. The developing unit 10D uses a black color toner.

Figure 5:
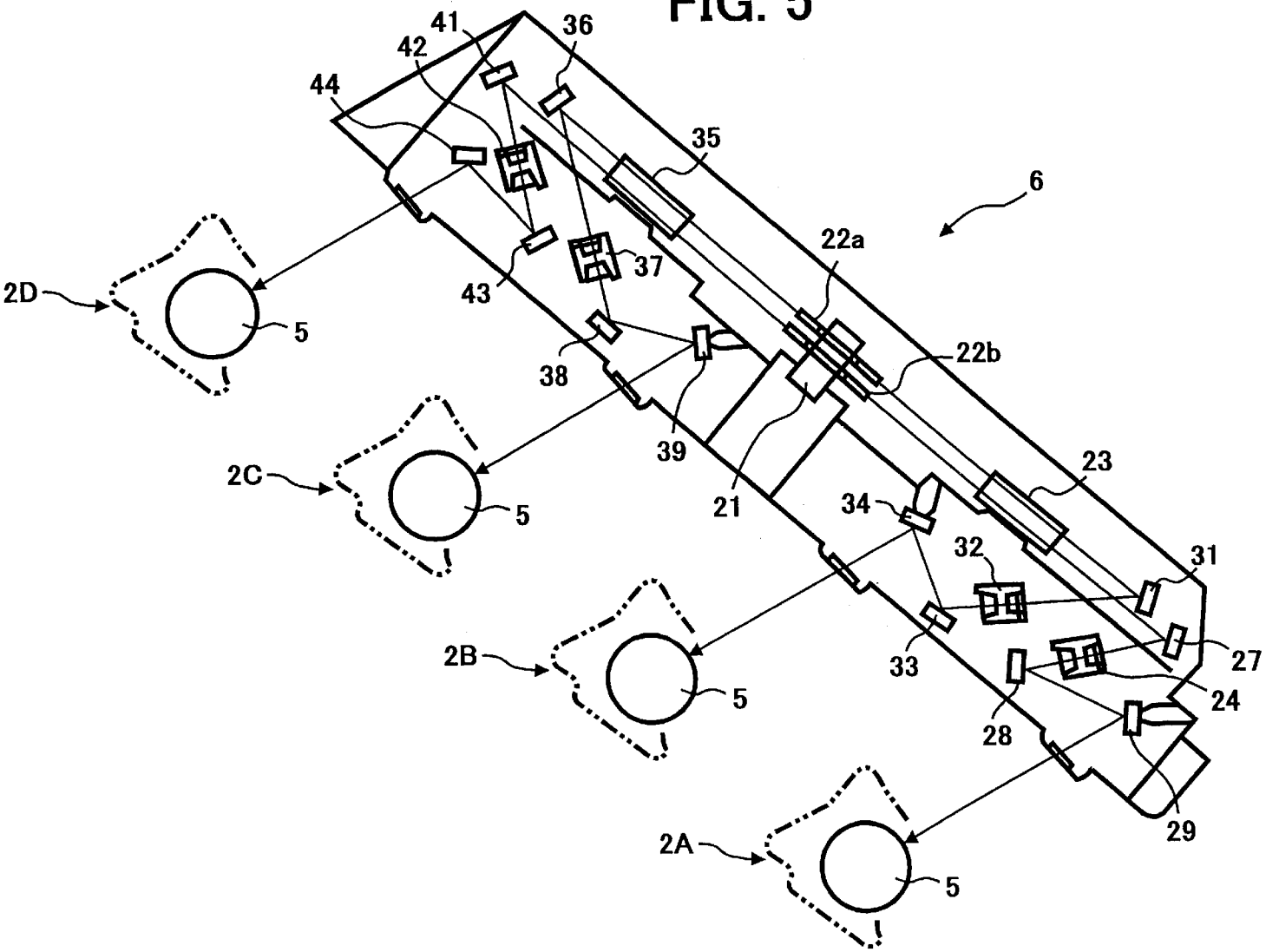
FIG. 5 is a configuration diagram illustrating a write unit of the compact printer as illustrated in FIG. 3.

A write unit 6 shown in FIG. 5 is a one-polygon motor write unit emitting one color beam or two monochromatic beams of the laser diode (LD) type and having two hexagonal rotary mirrors 22*a* and 22*b*. In the write unit 6, light emitted from the laser diode not shown serving as a light source is reflected by the rotary polygonal mirrors 22*a* and 22*b* rotated by a polygon motor 21 into scanning beams for yellow, magenta, cyan, and black.

The scanning beams for yellow and magenta pass through a two-layer fθ lens 23, respectively. The scanning beam for yellow is reflected by a mirror 27, passes through a long WTL 24, and is irradiated onto the photosensitive drum 5 of the photosensitive unit 2A via mirrors 28 and 29. The scanning beam for magenta is reflected by a mirror 31, passes through a long WTL 32, and is irradiated onto the photosensitive drum 5 of the photosensitive unit 2B via mirrors 33 and 34.

The scanning beams for cyan and black pass through a two-layer fθ lens 35. The scanning beam for cyan is reflected by a mirror 36, passes through a long WTL 37, and is irradiated onto the photosensitive drum 5 of the photosensitive unit 2C via mirrors 38 and 39. The scanning beam for black is reflected by a mirror 41, passes through a long WTL 42, and is irradiated onto the photosensitive drum 5 of the photosensitive unit 2D via mirrors 43 and 44.

The duplex unit 7 shown in FIG. 3 comprises a pair of conveyance guide plates 45*a* and 45*b*, and a plurality of pairs (four pairs in this example) of conveying rollers 46. In the duplex image forming mode of forming image on the both sides of the transfer sheet of paper, the process of the duplex unit 7 comprises the steps of forming an image on one side, conveying the transfer sheet bearing the thus formed image to a reversal conveying path 54 of the reversing unit 8, receiving the switchback-conveyed transfer sheet P, and re-conveying the same to an image formation section having the photosensitive units 2A to 2D provided therein.

The reversing unit 8 comprises a plurality of pairs of conveying rollers, and a plurality of pairs of conveyance guide plates, and serves to reverse the transfer sheet P upon forming images on the both sides as described above, convey the reversed transfer sheet to the duplex unit 7, discharge the transfer sheet P after image forming to an outside of the apparatus in the direction as it is or with it being reversed. In a paper feed section including paper feed cassettes 11 and 12, a pair of separated paper feed sections 55 and 56 feeding the transfer sheets one by one are provided, respectively.

In this compact printer, the roller curvature separating method using a transfer belt 3 is adopted. Four transfer brushes 57 corresponding to the four photosensitive drums 5 are provided in the transfer belt 3, respectively.

When starting the image forming operation, in this compact printer, the photosensitive drums 5 rotate clockwise in FIG. 3 while impressing a voltage between the photosensitive drums 5 and the charge rollers 14 of the charge units, the surfaces of the photosensitive drums 5 are uniformly charged. A laser beam corresponding to a yellow color image is irradiated by the write unit 6 onto the charge surface of the photosensitive drum 5 of the photosensitive unit 2A.

A laser beam corresponding to a cyan color image is irradiated by the write unit 6 onto the charge surface of the photosensitive drum of the photosensitive unit 2B. A laser beam corresponding to a magenta color image is irradiated onto the charge surface of the photosensitive drum of the photosensitive unit 2C. A laser beam corresponding to a black color image is irradiated onto the charge surface of the photosensitive drum 5 of the photosensitive unit 2D. A plurality of latent images is thus formed corresponding to the individual colors. When the latent images reach the positions of the developing units 10A, 10B, 10C, and 10D along with rotation of the photosensitive drums 5, respectively, the latent images are developed by toners of yellow, magenta, cyan, and black into toner images of four colors.

On the other hand, a paper is fed by the separated paper feed section 55 or 56 from a paper feed stage selected from among the paper feed cassettes 11 and 12, and the paper is conveyed to the space between the photosensitive drum 5 of the photosensitive unit 2A and the transfer belt 3 at an accurate timing when the same synchronizes with the toner images formed on the individual photosensitive drums 5 by a resist roller pair 59 provided immediately before the photosensitive unit 2A.

At this point in time, the transfer paper P is charged in plus polarity by a paper attraction roller 58 arranged in the vicinity of the entry of the transfer belt 3, and electrostatically attracted onto the surface of the transfer belt 3. The toner images of yellow, magenta, cyan, and black colors are sequentially transferred onto the upper side surface of the transfer paper P in FIG. 3 while being attracted and conveyed by the rotation of the transfer belt 3 in the arrow A direction. When the paper passes through the photosensitive unit 2D, a full-color toner image including combination of four colors is thus formed.

The toner image is fixed through melting onto the transfer sheet of paper P when heat and pressing force are applied thereto in a fixing unit 9. Subsequently, the paper P passes through the paper discharge system corresponding to a specified mode, and is reversed and discharged onto a paper discharge tray 26 arranged on the top of the apparatus main body. Otherwise, it is sent straight from the fixing unit 9 and discharged straight through the reversing unit 8.

Otherwise, when the duplex image formation mode is selected, the transfer paper is fed to a reverse conveyance path 54 in the above-mentioned reversing unit 8, and after switched back, conveyed to the duplex unit 7. The paper is fed again therefrom and discharged after image forming on the back in the image formation section having the photosensitive units 2A to 2D provided therein. Subsequently, when two or more image formations are instructed, the image forming process described above is repeated.

This compact printer has photosensitive drums 5 as described above with reference to FIG. 1. A photosensitive drum 5 has a coated portion 61 forming a photosensitive layer and non-coated portions 62 and 62 formed of a material harder than the coated portion 61 on the both sides thereof. A charge unit 4 charges the portion of the effective charge width (Wac) of the coated portion 61. The charge roller 14 of the charge unit 4 is brought into contact with the surface of the photosensitive drum 5 via the tape members 18 and 18 that contacts with a non-charged area of the coated portion of the photosensitive drum 5, and a prescribed gap G is formed between the portion of the charge roller 14 of the effective charge width (Wac) of the charge unit 4 and the surface of the photosensitive drum 5.

Therefore, wear and damage to the tape member 18 can be reduced as compared with a case where the tap member 18 is in contact with the non-coated portion 62 formed of a material harder than the coated portion 61. As a result, since the tape member 18 is hardly susceptible to wear even when it has a thickness of under about 100 $\mu$m to obtain a satisfactory charge performance, the gap G between the charge roller 14 and the surface of the photosensitive drum 5 can be maintained at a prescribed gap volume while giving a satisfactory charge performance for a long period of time. It is therefore possible to maintain a high image quality with the lapse of time.

Figure 6:
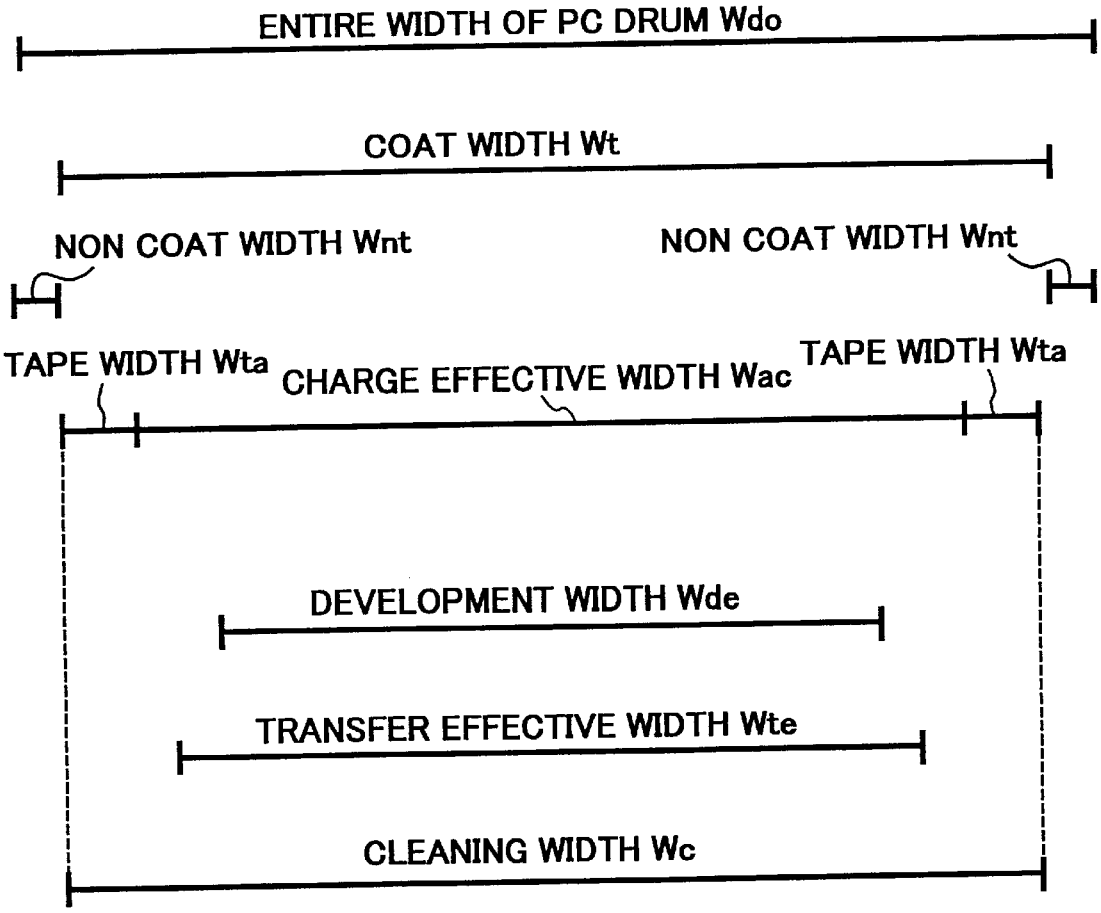
FIG. 6 is a schematic view comparing the width relationship for component parts of the image building system of the compact printer shown in FIG. 3.

FIG. 6 is a schematic view relatively comparing widths of various component parts of the image forming system of the compact printer shown in FIG. 3. The component parameters forming the image forming system of the compact printer shown in FIG. 3, having the width relationship as shown in FIG. 6, comprise the total width (Wdo) of the photosensitive drum 5 in the longitudinal direction. Specifically, the coating width Wt of the coated portion 61 of the photosensitive drum 5, the non-coating width Wnt of the non-coated portion 62 of the photosensitive drum 5, the effective charge width (Wac) of the charge unit 4, the tape width Wta of the right and left tape members 18 and 18, the developing width Wde of the developing units 10A to 10D, the effective transfer width Wte of the transfer unit having the transfer belt 3, and the cleaning width Wc of the cleaning blade 47 are included (see FIGS. 3 and 4).

More specifically, the pair of tape members 18 and 18 (arranged at a position of the tape width Wta) are positioned within the cleaning width Wc of the cleaning blade 47 which comes into sliding contact with the coated portion 61 of the photosensitive drum 5 and cleans the coated portion 61 thereof. As a result, even when an area of the cleaning width Wc is worn out with the lapse of time by sliding contact of the coated portion 61 of the photosensitive drum 5 with the cleaning lade 47 (see FIG. 4), the gap G between the effective charge width (Wac) portion of the charge roller 14 shown in FIG. 1 and the surface of the photosensitive drum 5 can be kept always constant through contact of the both of the pair of tape members 18 and 18 with the worn portions. In this embodiment, the width between the insides of the pair of tape members 18 and 18 serve as the effective charge width (Wac) (see also FIG. 1 as required).

The effective transfer width Wte achieved by the transfer belt 3 (see FIG. 3) as the transfer member transferring a visible image formed on the surface of the photosensitive drum 5 by coming into contact with the coated portion 61 of the photosensitive drum 5 onto the transfer paper (transfer medium) should be smaller than the effective charge width of the charge unit 4. As a result, while deposition of the developer tends to easily occur because the charge potential becomes unstable in the vicinity of the portions outside the both ends of the effective charge width Wac of the surface of the photosensitive drum 5, it is possible to prevent the developer adhering in the vicinity of the portions outside the both ends of the effective charge width Wac (toner and carrier in the case of a two-component developer) from moving to the transfer belt 3 by using an effective transfer width Wte that is smaller than the effective charge width Wac.

Furthermore, the individual development widths Wde of the developing units 10A to 10D, that develop the latent image on the photosensitive drum 5 by use of the developer into a visible image, are smaller than the effective charge width Wac. As a result, it is possible to prevent the developer from adhering to portions in the vicinity of the both ends of the effective charge width Wac on the photosensitive drum 5. It is therefore possible to prevent the adverse effects resulting from expansion of the gap G caused by penetration of the developer into the space between the tape member 18 and the surface of the photosensitive drum 5, or caused by adhesion of the developer in the vicinity of the both ends of the effective charge width Wac.

The developing width Wde is smaller than the effective transfer width Wte. As a result, the developer can be made more difficult to adhere in the vicinity of the both ends of the effective charge width Wac on the photosensitive drum 5.

When the developer is a two-component developer using a toner and a carrier, it is possible to prevent both the toner and the carrier from adhering to portions in the vicinity of the both ends of the effective charge width Wac on the photosensitive drum 5.

The cleaning width Wc is wider than the effective charge width Wac. As a result, even when deposit such as a developer or the like adheres to portions in the vicinity of the both ends of the effective charge width Wac on the photosensitive drum 5, these portions can be cleaned by the cleaning blade 47 (see FIG. 4), thus permitting prevention of an adverse effect of such deposit.

Figure 7:
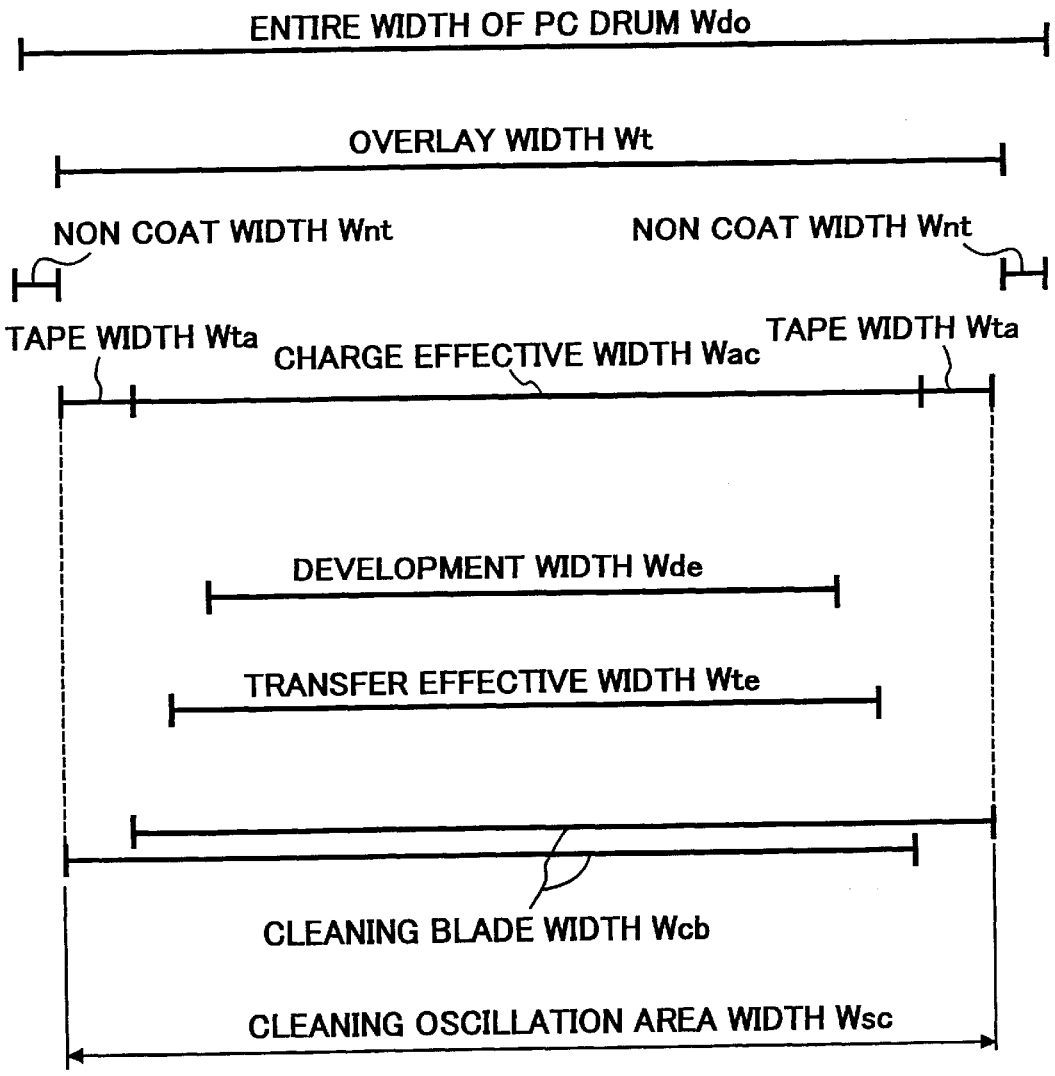
FIG. 7 is a schematic view illustrating the width relationship between the component parts of the image building system employed in another embodiment of the image forming apparatus according to the present invention.

FIG. 7 is a schematic view, similar to FIG. 6, comparing various component parts and illustrates as to the width relationship in another embodiment of the image forming apparatus according to the present invention. The compact printer as the image forming apparatus of this embodiment is substantially the same as that described above with reference to FIG. 6 except that the cleaning blade 47 shown in FIG. 8 oscillates in the arrow F direction perpendicular to the sliding-contact direction relative to the photosensitive drum 5. The other component parts are also substantially the same as in the compact printer described above with reference to FIGS. 1 to 6. Thus, drawings and description of the compact printer as a whole are omitted.

Figure 8:
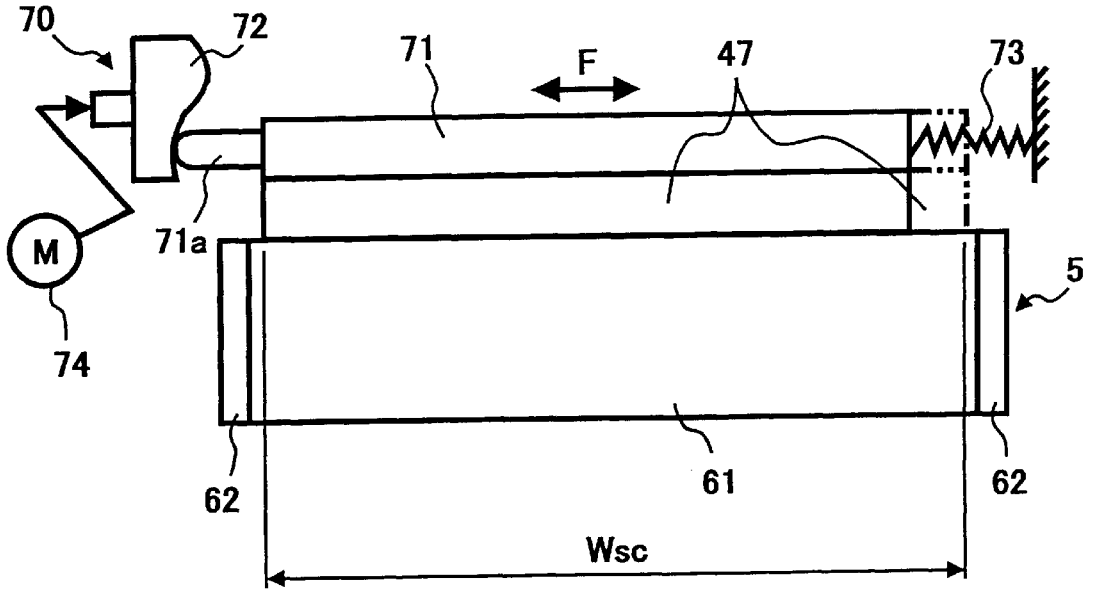
FIG. 8 is a schematic view for illustrating a cleaning member oscillation mechanism of the image forming apparatus.

In this embodiment, as shown in FIG. 8, a cleaning member oscillation mechanism 70 is provided, which oscillates the cleaning blade 47 which is the cleaning member of the cleaning member in the arrow F direction perpendicular to the sliding-contact direction of the cleaning blade 47 with the photosensitive drum 5.

The cleaning member oscillation mechanism 70 includes a blade holding member 71 supported so as to be capable of being oscillated in the arrow F direction while holding the cleaning blade 47, a cam 72 having a cam surface slidably in contact with a hemispheric portion at the leading end of a projection 71*a* formed at the left end of the blade holding member 72, a compression coil spring 73 imparting a pressing force to the blade holding member 71 so as to press the hemispheric portion at the leading end of the projection 71 a against the cam surface of the cam 72, and a motor 74 rotating the cam 72.

When the cam 72 has made one rotation, the cleaning blade 47 oscillates, together with the blade holding member 71, and makes one reciprocation. With the cleaning oscillation area width Wsc oscillated by the cleaning member oscillation mechanism 70 as the cleaning width, the cleaning width is positioned within the coated portion 61, and the pair of tape members 18 and 18 are arranged, as shown in FIG. 7, within the cleaning oscillation area width Wsc (arranged at positions of the individual tape widths Wta).

According to this embodiment, the cleaning blade 47 is not in sliding contact with the joint of the coated portion 61 and the non-coated portion 62 or with the non-coated portion. It is therefore possible to prevent turnover of the cleaning blade 47, thus permitting avoidance of premature wearing thereof.

In this embodiment, furthermore, the displacement limit positions on the both sides of the cleaning blade 47 oscillated by the cleaning member oscillation mechanism 70 (right and left end positions of the cleaning oscillation area width Wsc) are located outside the effective charge width Wac, respectively. Therefore, even when a deposit such as the developer adheres to portions at the both ends of the effective charge width Wac, it is possible to clean off such a deposit by use of the cleaning blade 47, thus preventing an adverse effect caused by such a deposit.

Figure 9:
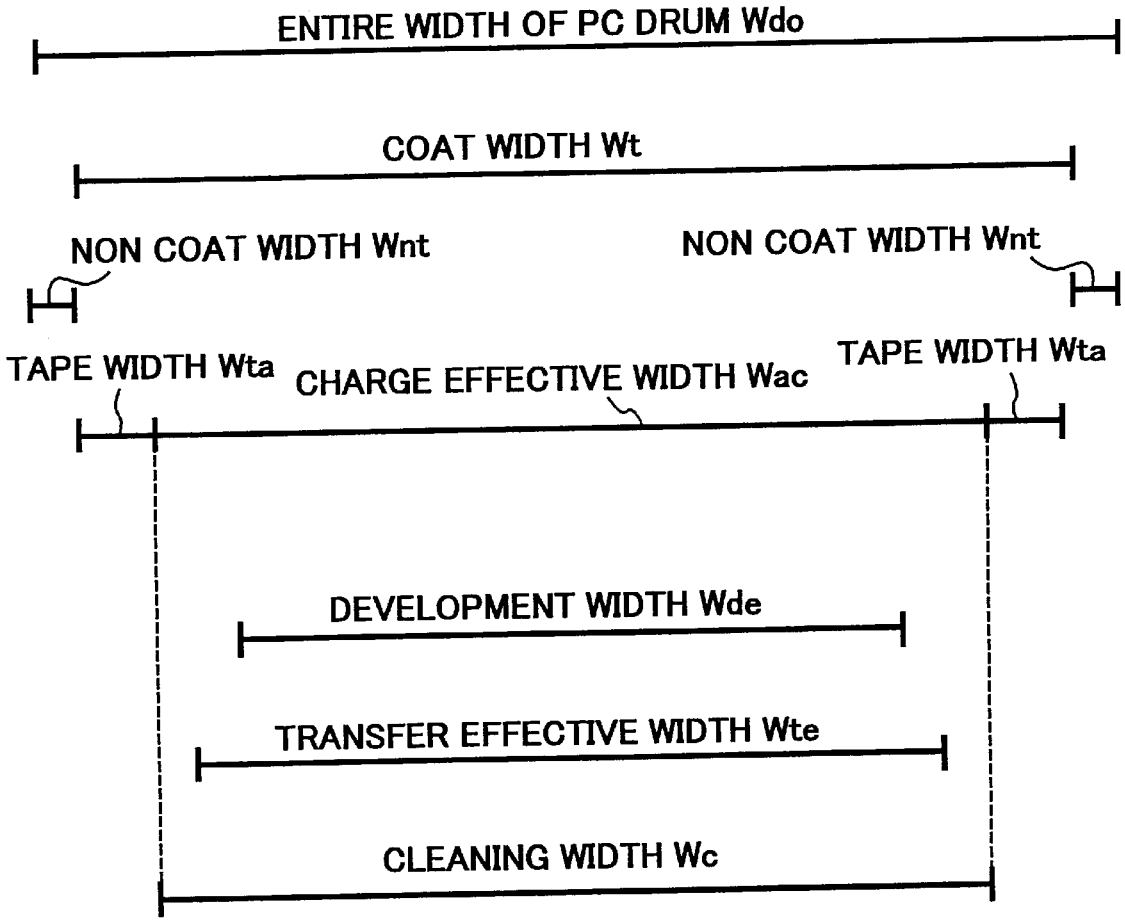
FIG. 9 is a schematic view illustrating an embodiment of the image forming apparatus in which the cleaning width of the cleaning member is positioned inside a pair of tape members, respectively.

FIG. 9 is a schematic view, similar to FIG. 6, illustrating an embodiment of an image forming apparatus in which the cleaning width of the cleaning member is located inside the pair of tape members. The compact printer as the image forming apparatus of this embodiment has substantially the same configuration as that of the compact printer described above with reference to FIGS. 1 to 6 except for the positional relationship in the width direction of the pair of tape members 18 and 18 relative to the cleaning width Wc. Representation of the component parts in drawings is therefore omitted, and the reference numerals used in FIGS. 1 to 6 will be used for description as required.

In the compact printer according to this embodiment, the cleaning width Wc of the cleaning blade 47 is located inside the pair of tape members 18 and 18 on the both sides (arranged at positions of the right and left tape widths Wta in FIG. 9). As a result, in this embodiment, the area of the cleaning width Wc for the coated portion 61 forming the photosensitive layer on the surface of the photosensitive drum 5 (positioned at the coating width Wt portion) wears with time. On the other hand, since the tape members 18 and 18 on the both sides are positioned outside the cleaning widths Wc provided by the cleaning blade 47, respectively, the portions of the coated portion 61 in contact with the tape members 18 and 18 are not ground by the cleaning blade 47.

As a result, according as the area of the cleaning width Wc of the coated portion 61 is gradually ground off by the cleaning blade 47, the gap G between the charge roller 14 and the surface of the photosensitive drum 5 described above with reference to FIG. 1 gradually becomes larger up to a gap causing occurrence of defective charging. In this compact printer, therefore, the end of the service life of the photosensitive drum 5 can be determined by utilization of the timing of occurrence of such defective charging.

The toner remaining after transfer or the like generally collected from the photosensitive drum 5 tends to easily drop from the both ends of the cleaning blade 47. When residual toner adheres again to the photosensitive drum 5 and then adheres to the tape member 18, the gap G between the photosensitive drum 5 and the charge roller 14 may sometimes become larger. However, when the cleaning width Wc is positioned inside the tape members 18 and 18 on the both sides, the collected toner having dropped from the cleaning blade 47 becomes harder to adhere to the tape members 18, thus permitting prevention of the gap G from becoming larger.

Figure 10:
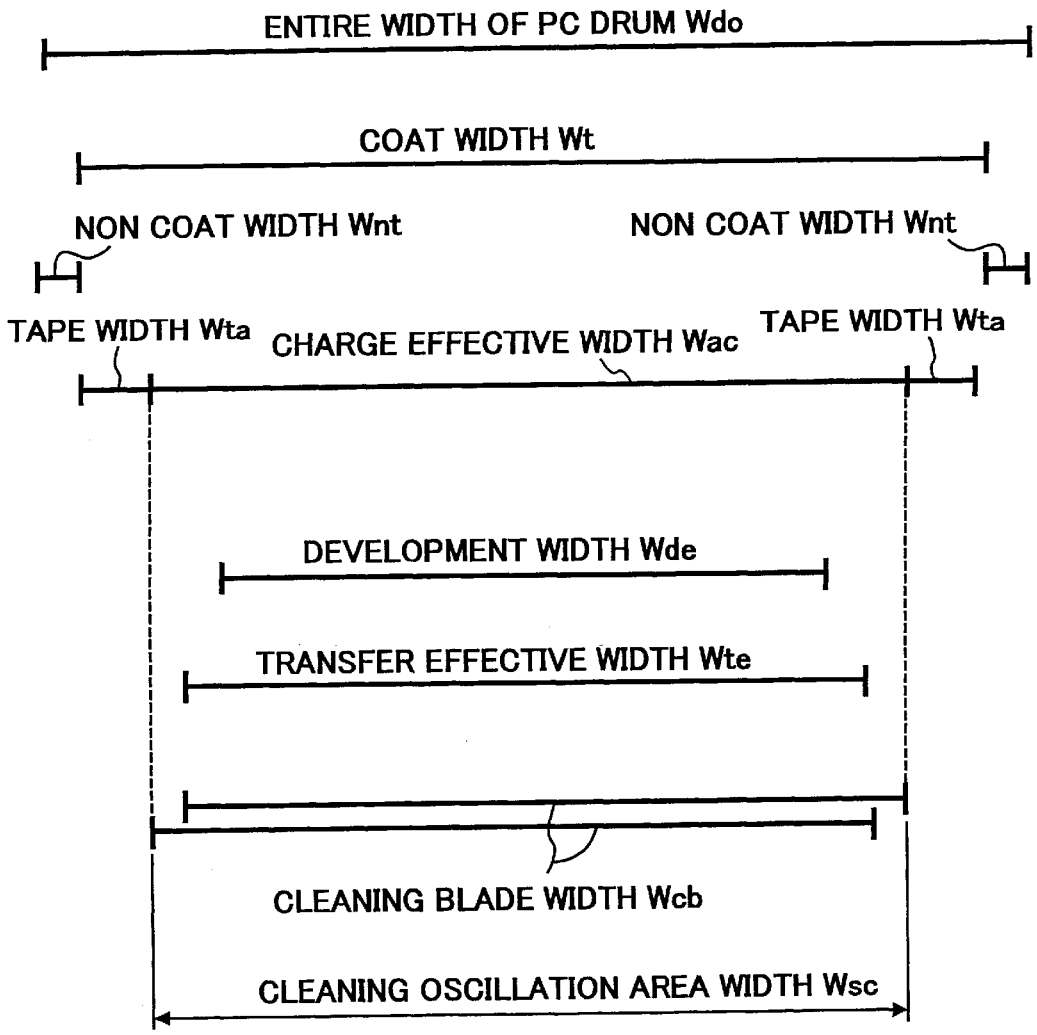
FIG. 10 is a schematic view illustrating the width relationship between the component parts of image building system employed in still another embodiment of the image forming apparatus according to the present invention.

FIG. 10 is a schematic view, similar to FIG. 7, comparing the width relationship for the components of the image building system in still another embodiment of the image forming apparatus according to the present invention.

In the compact printer as the image forming apparatus of this embodiment, in contrast to the embodiments described above with reference to FIGS. 8 and 9, the cleaning blade 47 is oscillated in a direction perpendicular to the sliding contact direction with the photosensitive drum 5 by the cleaning member oscillation mechanism 70. The cleaning oscillation area width Wse of the cleaning blade 47 oscillated by the cleaning member oscillation mechanism 70 is used as a cleaning width. The cleaning width is positioned inside the coated portion 61 of the photosensitive drum 5 as shown in FIG. 10 (positioned at the coating width Wt portion). The right and left ends of the cleaning oscillation area width Wse are positioned inside the pair of tape members 18 and 18 on the both sides (arranged at positions of the right and left tape widths Wta in FIG. 10).

In this embodiment as well, the cleaning blade 47 is never in sliding contact with the joint of the coated portion 61 and the non-coated portion 62 of the photosensitive drum 5 or with the non-coated portion, thus permitting prevention of premature wear of the cleaning blade 47.

The displacement limit positions of the both sides of the cleaning blade 47 oscillated by the cleaning member oscillation mechanism 70 (the right and left end positions of the cleaning oscillation area width Ws) are positioned inside the tape members 18 and 18 on the both sides, respectively. As in the embodiment of FIG. 9, therefore, the gap G between the charge roller 14 described above with reference to FIG. 1 and the surface of the photosensitive drum 5 becomes gradually larger through gradual grinding of the cleaning oscillation area width Wse portion of the coated portion 61 by the cleaning blade 47. The end of the service life of the photosensitive drum 5 can therefore be determined from the timing of occurrence of defective charging resulting from the enlargement of the gap G.

Figure 11:
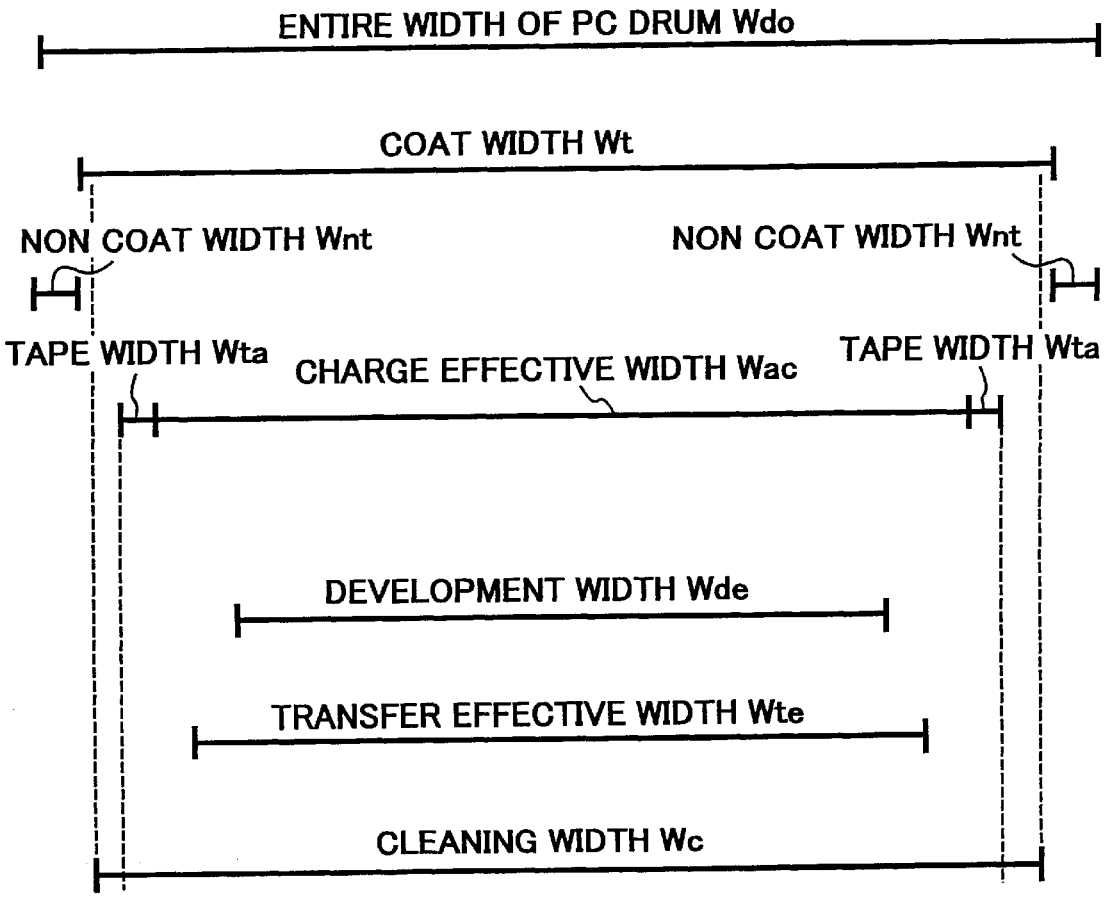
FIG. 11 is a schematic view illustrating an embodiment of the image forming apparatus in which the cleaning width covers prescribed portions outside the outer ends of the pair of tape members, respectively.

FIG. 11 is a schematic view, similar to FIG. 6, illustrating another embodiment of the image forming apparatus in which the cleaning width extends to outside the outer ends of the pair of tape members. The compact printer as the image forming apparatus of this embodiment has substantially the same configuration as that of the compact printer described above with reference to FIG. 6 except that the cleaning width Wc extends even to outside the outer ends of the pair of tape members 18 and 18. Representation of the other components in drawings will therefore be omitted, and the reference numerals used in FIGS. 1 to 6 will be used as required for description.

When the cleaning width Wc covers even outside the outer ends of the pair of tape members 18 and 18, as in the compact printer described in FIG. 6, even if the area of the cleaning width Wc of the coated portion 61 of the photosensitive drum 5 is worn out with time by the sliding contact of the cleaning blade 47 (see FIG. 4), the tape members 18 and 18 arranged at a pair of positions indicated by the tape width Wta in FIG. 11 come into contact with the worn portion with a room in the width direction (right and left directions in FIG. 11). It is therefore possible to keep a constant gap G between the portion of the charge roller 14 corresponding to the effective charge width Wac shown in FIG. 1 and the surface of the photosensitive dram 5, thus ensuring availability of a satisfactory image even after the lapse of some time.

Figure 12:
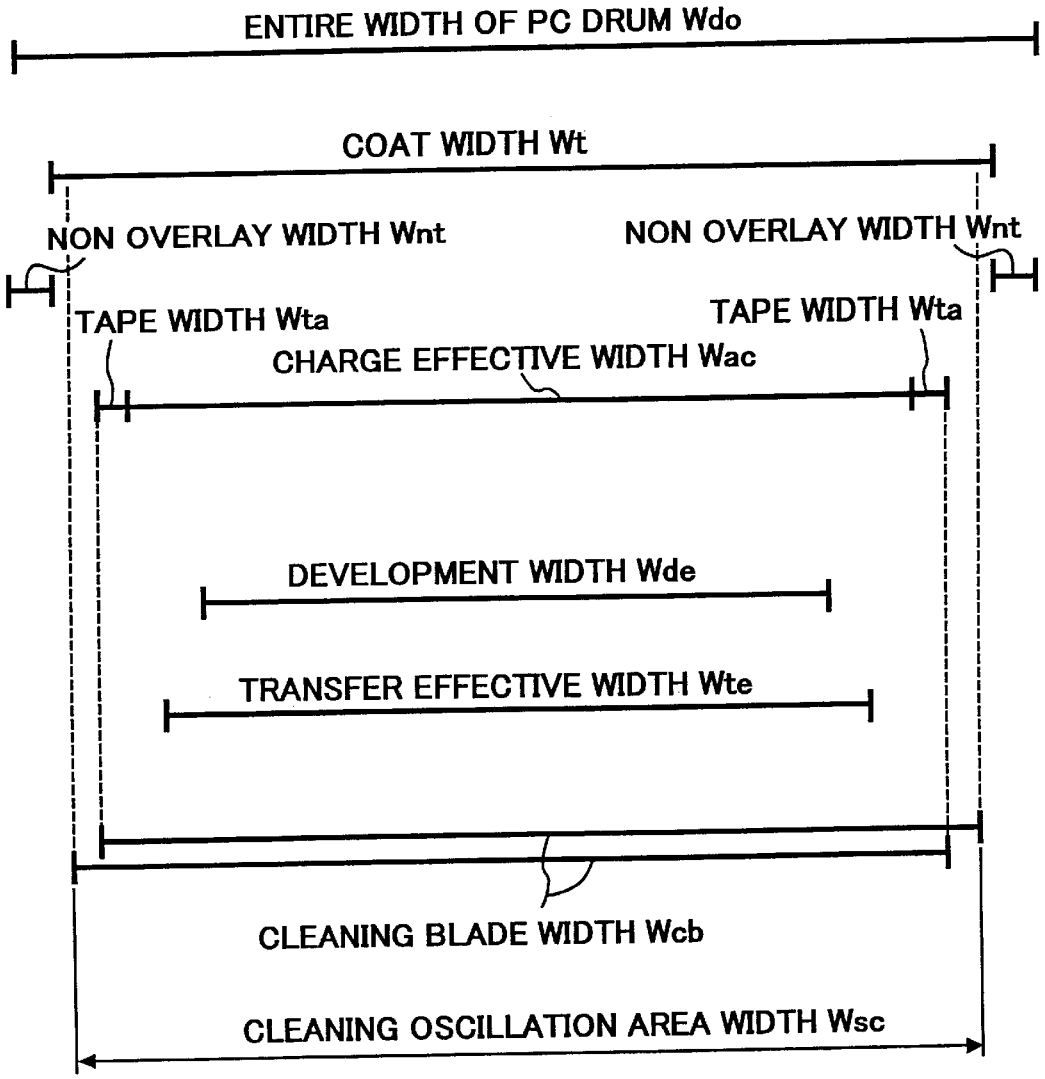
FIG. 12 is a schematic view illustrating an embodiment of the image forming apparatus in which the cleaning width of the oscillating cleaning blade extends to outside the outer ends of the pair of tape members.

FIG. 12 is a schematic view, similar to FIG. 7, illustrating another embodiment of an image forming apparatus in which the cleaning width of an oscillating cleaning blade extends to outside the outer ends of the pair of tape members, respectively. The compact printer as the image forming apparatus of this embodiment is substantially the same as the embodiment described above with reference to FIG. 11 except that, as in the embodiment described in FIG. 7, the cleaning blade 47 is oscillated by the cleaning member oscillation mechanism 70 in a direction perpendicular to the sliding contact direction with the photosensitive drum 5. In addition, the cleaning oscillation area width Wse of the cleaning blade 47 oscillated by the cleaning member oscillation mechanism 70 is used as a cleaning width. The cleaning width covers even outside of the outer ends of the pair of tape members 18 and 18 (arranged at positions of the right and left tape widths Wta in FIG. 12).

If this cleaning oscillation area width Wsc is used as the cleaning width, then, as in the compact printer described above with reference to FIG. 7, even when the cleaning width Wc area is worn out with time as a result of sliding contact of the coated portion 61 of the photostatic drum 5 with the cleaning blade 47 (see FIG. 4), the pair of tape members 18 and 18 come into contact with the worn portion with a room in the width direction (right to left direction in FIG. 11). It is therefore possible, in this embodiment as well, to always keep a constant gap G between the portion of the effective charge width Wac of the charge roller 14 shown in FIG. 1 and the surface of the photosensitive drum 5, whereby a satisfactory image is available even after the lapse of time.

Figure 13:
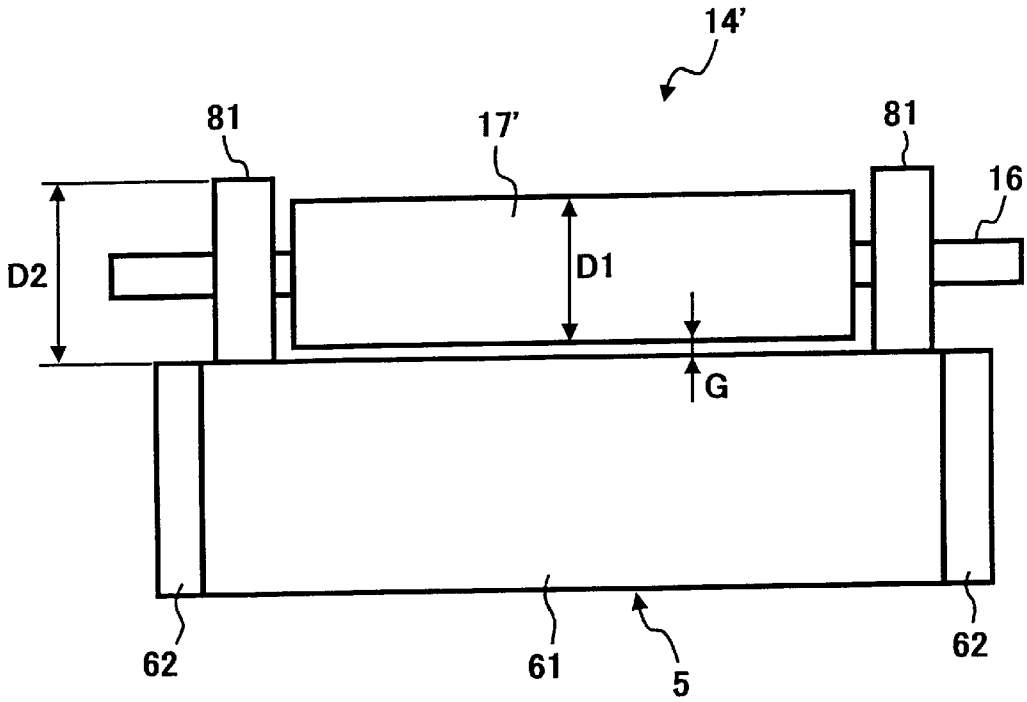
FIG. 13 is a front view illustrating an embodiment in which the gap control member comprises rollers.

FIG. 13 is a front view illustrating another embodiment in which the gap control member is in the form of a roller.

The gap control member of this embodiment includes a pair of rollers 81 and 81 attached to both ends of a core, respectively, formed of a metal shaft of a charge roller 14'. The roller 81 is made, for example, of rubber, and has an outside diameter $D_2$ larger than the outside diameter $D_1$ of a conductive rubber roller section 17' of the charge roller 14'. Thus, a gap G (for example, of rubber 100 $\mu$m) may be formed by the difference between the outside diameters $D_1$ and $D_2$.

In this embodiment as well, the pair of rollers 81 and 81 are in contact with a non-charged area of a coated portion 61 softer than a non-coated portion 62 of the photosensitive drum 5. Therefore, even when setting the gap G to a size under about 100 $\mu$m, the roller 81 hard to be worn can maintain an amount of gap G permitting satisfactory charging for a long period of time. Such an advantage has been recognized through an experimentation wherein a wear level, such as a cut, peeling off, etc., of the tape is investigated in different cases when the tape engages with coated and non-coated portions, while continuously feeding a plurality of papers. The experimentation result is obtained by performing copy run three times and picking the worst tape up among those in different mono color stations as illustrated in FIG. 19. In FIG. 19, a double circle represents that no cut exists, a single circle represents that a few scratch marks exist on a surface but no problem occurs, and a white triangle represents that a cut exists on a tape and foreign substance enters into and extrudes from the cut (i.e., resulting in abnormal image). In addition, a black triangle represents that an end of a tape is peeled off, and a cross represents that a tape is peeled of and substantially disappears.

The various embodiments of the image forming apparatus of the present invention have been described above. In these embodiments, the both ends of the core 16 should preferably be spaced apart from the non-coated portion 62 at a position not causing leakage from the both ends of the core 16 to the non-coated portion 62 of the photosensitive drum 5 when impressing a voltage between the core (metal shaft) 16 and the photosensitive drum 5 for the charge rollers 14 and 14'.

Another embodiment is now described with reference to FIGS. 14 to 17. In this compact printer, as described in FIG. 1, a prescribed gap C is formed at the portion of the image forming area Wac between the charge roller 14 and the photosensitive 5 by causing the pair of tape members 18 and 18 to be present between the charge roller 14 and the photosensitive drum 5. The size of the gap C is controlled so that the following relationship is established when the axial straightness of the surface of the photosensitive drum 5 is D, and that of the surface of the conductive rubber roller 17 of the charge roller 14 is E:

$$D+E<C$$

Figure 14:
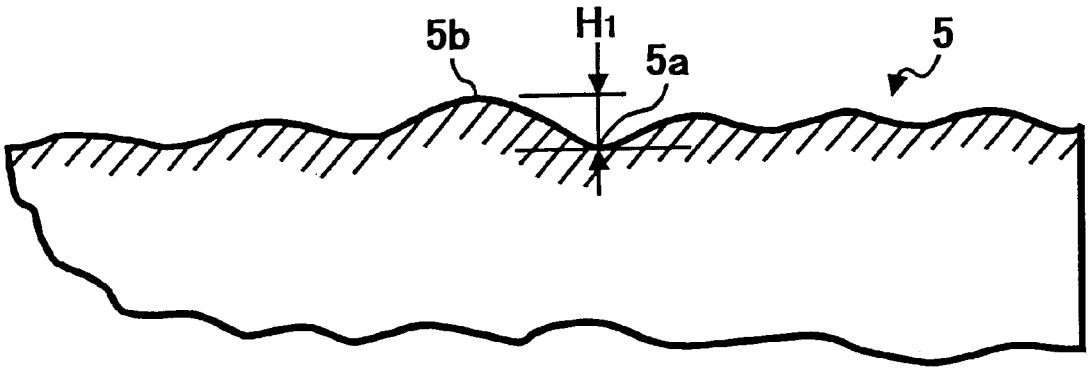
FIG. 14 is a schematic view illustrating an example of the conventional charge roller.
Figure 15:
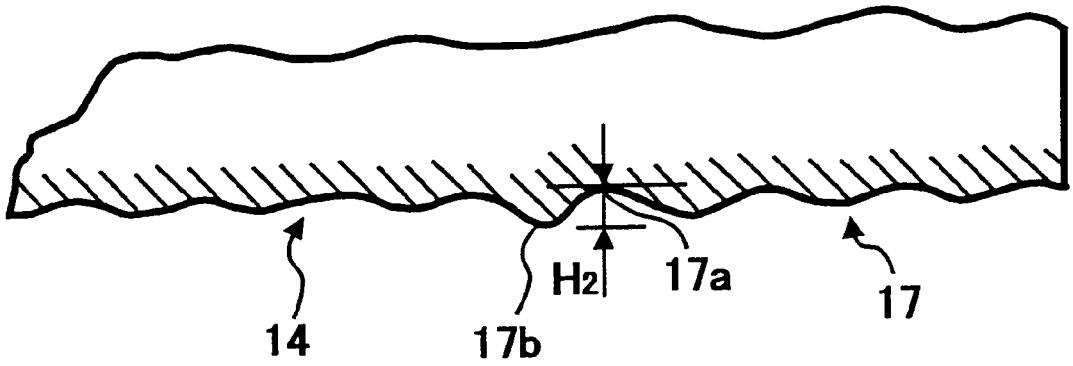
FIG. 15 is a descriptive view for explaining the axial straightness of the surface of the photosensitive drum.
Figure 16:
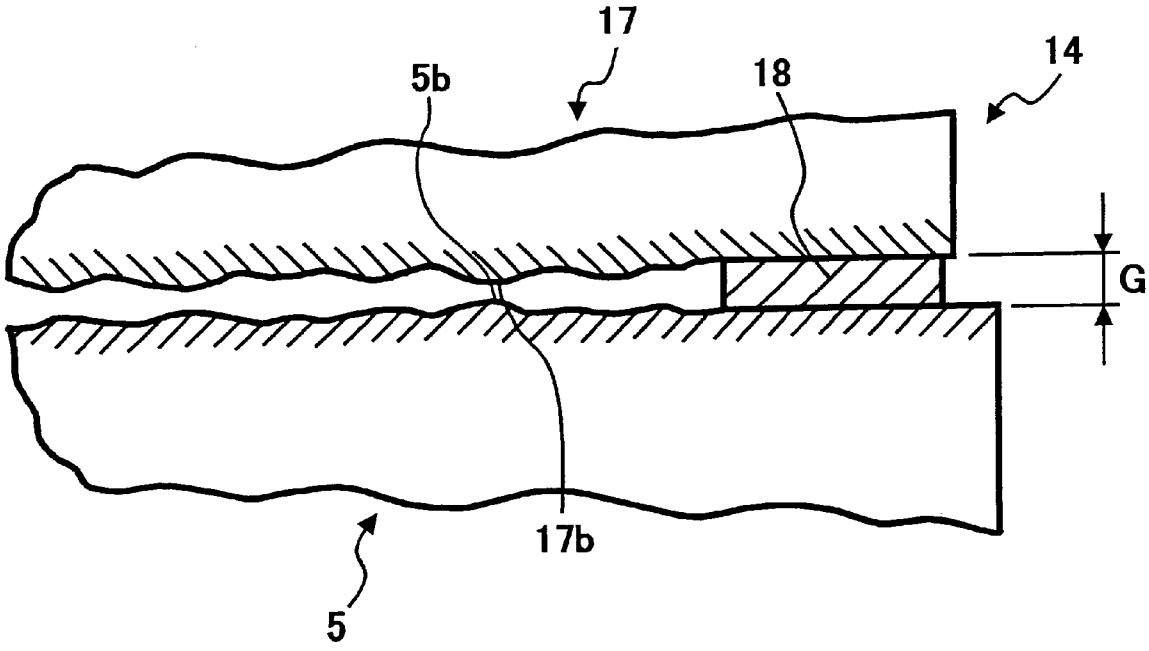
FIG. 16 is a descriptive view for explaining the axial straightness of the surface of the conductive rubber roller of the charge roller.

The surfaces of all of the component parts have fine irregularities unavoidable in manufacture. As shown in FIG. 14 illustrating an axial cross-sectional shape of the photosensitive drum 5 in an enlarged form, the gap G shown in FIG. 1 is designed larger than a value obtained by adding the axial straightness D ($=H_1$) of the photosensitive drum 5 which is determinable from the height H1 from the trough bottom 5*a* to the highest peak 5*b* formed on the surface of the photosensitive drum 5, and the axial straightness E of the charge roller 14 which is determinable from the height $H_2$ from the trough bottom 17*a* to the highest peak 17*b* formed on the surface of the conductive rubber roller 17 of the charge roller 14 (=$H_2$).

The gap G satisfying the above-mentioned relationship depends upon the thickness of the tape members 18 and 18 wound onto the outer periphery of the both ends of the conductive rubber roller 17 of the charge roller 14. By thus designing, even when the peak 5*b* of the photosensitive drum 5 and the trough 17*b* of the conductive rubber roller 17*b* of the charge roller 14 face each other as shown in FIG. 8, the peak 5*b* of the photosensitive drum 5 and the trough 17*b* of the conductive rubber roller 17 of the charge roller 14 never come into contact with each other, because the relationship (D+E<C) is satisfied.

According to this image forming apparatus, therefore, even when a deposit such as residual toner adheres to the surface of the photosensitive drum 5, the deposit never moves to the surface of the charge roller 14, because the charge roller 14 does not come into contact with the surface of the photosensitive drum 5. As a result, satisfactory charge performance is obtained together with a high-quality image. An excessively large gap G deteriorates charge performance. It should preferably be under, for example, 100 $\mu$m.

If the highest degree of straightness among axial straightness values at a plurality of different positions in the circumferential direction of the surface of the photosensitive drum 5 is D, and the highest degree of straightness among axial straightness values at a plurality of different positions in the circumferential direction of the surface of the conductive rubber roller 17 of the charge roller 14 is E, there is almost no probability that the peak 5*b* of the photosensitive drum 5 and the peak 17*b* of the conductive rubber roller 17 of the charge roller 14 come into contact with each other over the entire circumference.

However, even when the straightness D is determined only from the straightness in one axial direction on the surface of the photosensitive drum 5, and the straightness E is determined only from the straightness in one axial direction on the surface of the conductive rubber roller 17 of the charge roller 14, since these values of straightness do not differ much in general from values of straightness at the other positions in the circumferential direction, no particular problem generally is therefore encountered. In such a situation, even when the peak 5*b* of the photosensitive drum 5 and the peak 17*b* of the conductive rubber roller 17 of the charge roller 14 come into instantaneous pin-point contact with each other at a certain timing, since this is not a constant contact, it poses no problem.

Figure 17:
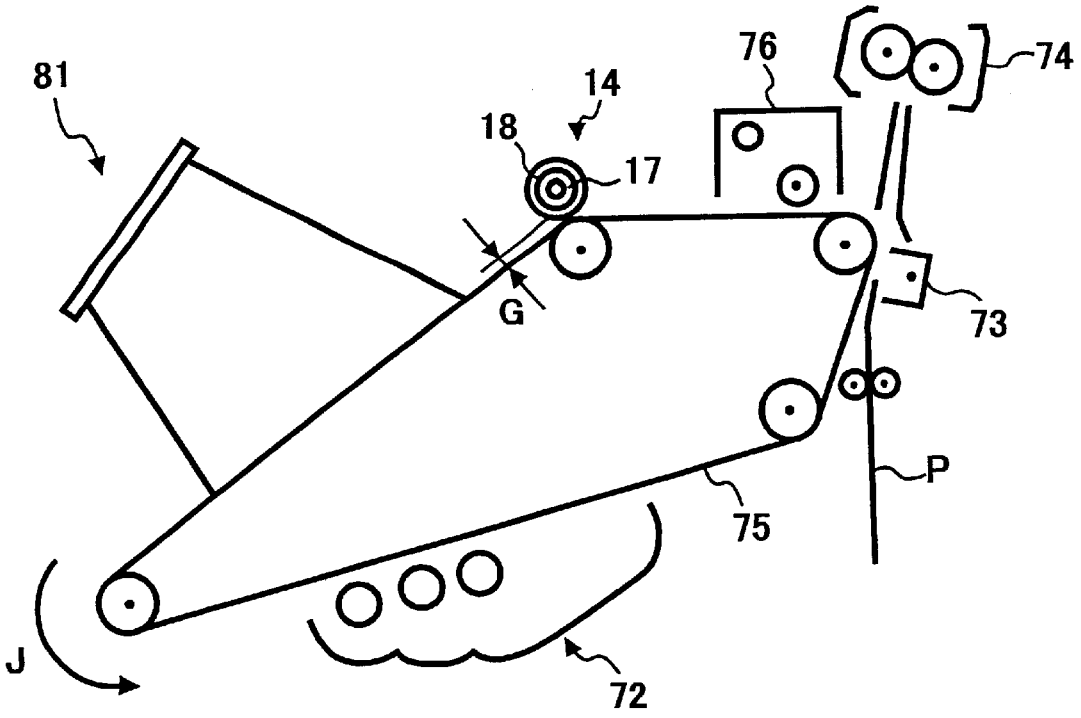
FIG. 17 is a schematic view illustrating a state in which a peak of the photosensitive drum and the peak of the conductive rubber roller of the charge roller facing each other.
Figure 18:
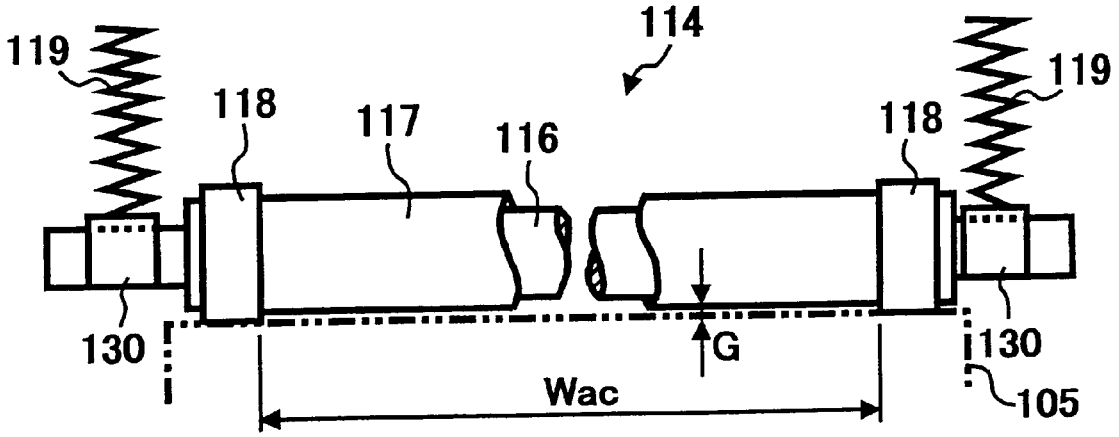
FIG. 18 is a front view illustrating a charge roller and a photosensitive drum in an embodiment which rollers serve as butt-contact members.

FIG. 17 is a schematic configuration diagram illustrating the proximity of the image formation section of an image forming apparatus in which the image carrier is a belt-shaped photosensitive belt. In the image forming apparatus of this embodiment, a belt-shaped photosensitive belt 75 is provided as an image carrier so as to be stretched between a plurality of rollers of the image formation section and rotates in the arrow J direction.

The charge roller 14 of the charge unit charges the surface of the photosensitive belt 75. The charged surface is exposed by an optical system 81 including a light source, an illuminating mirror, a projecting lens, a projecting mirror and the like, so that a latent image is formed there. When moving to the position of the developing unit 72 through rotation in the arrow J direction of the photosensitive belt 75, the latent image is developed by the developing unit 72 into a visible image (i.e., toner image).

Then, the visible image is transferred by a transfer section 73 onto the transfer sheet of paper P. The toner image is heated and fixed by a fixing unit 74, and discharged into a paper discharge tray or the like (not shown). The cleaning unit 76 cleans off residual toner remaining on the surface of the photosensitive belt 75, and the next run of an image forming operation is repeated.

In this image forming apparatus as well, by bringing the portion of the tape members 18 and 18 wound around and fixed to the both ends of the conductive rubber roller 17 into contact with the portion of the image forming area on the surface of the photosensitive belt 75 as the image carrier (see the image forming area Ac described above with reference to FIG. 1), the charge roller 14 forms a prescribed gap G corresponding to the thickness thereof in the portion of the image forming area. When the flatness of the surface of the photosensitive belt 75 is A, and the straightness (i.e., flatness when the charge member has a flat surface such as a blade) of the surface facing the photosensitive belt 75 of the charge roller 14 is B, the relationship A+B<C should be satisfied.

More specifically, the gap G is larger than a value obtained by adding the flatness B of the surface of the photosensitive belt 75 determinable from the height from the trough to the highest peak of the fine concave and convex portions formed on the surface of the photosensitive belt 75 and the straightness (flatness) A of the charge roller 14 determinable from the height from the trough to the highest peak formed on the surface of the conductive rubber roller 17 of the charge roller 14. By thus designing, the peak of the photosensitive belt 75 and the peak of the conductive rubber roller 17 of the charge roller 14 never come into contact with each other. As in the cases of the image forming apparatuses explained above with reference to FIGS. 1 to 8, therefore, it is possible to prevent a deposit such as residual toner remaining after transfer on the surface of the photosensitive belt 75 from moving to the charge roller 14.

Figure 20:
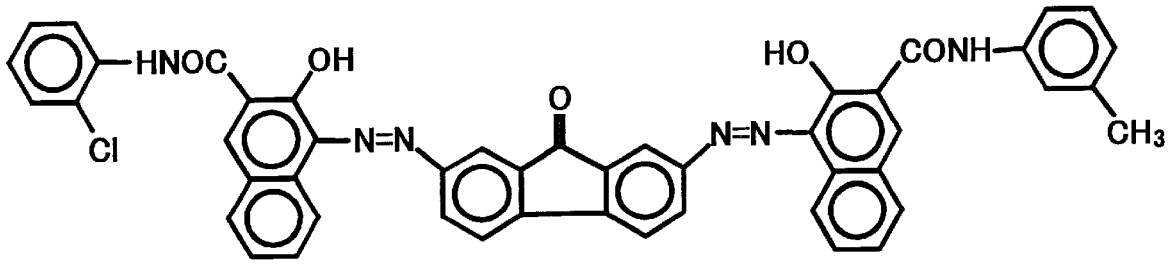
FIGS. 20, 21, and 22 are charts illustrating examples of chemical material of the photosensitive member.
Figure 21:
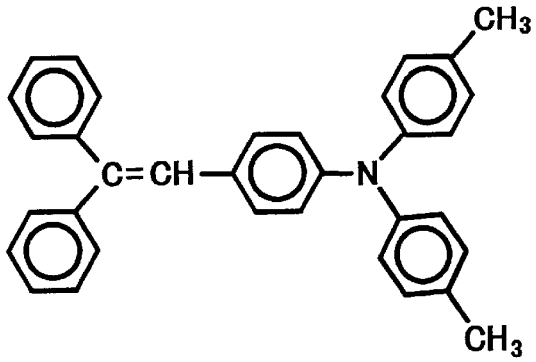
Figure 22:
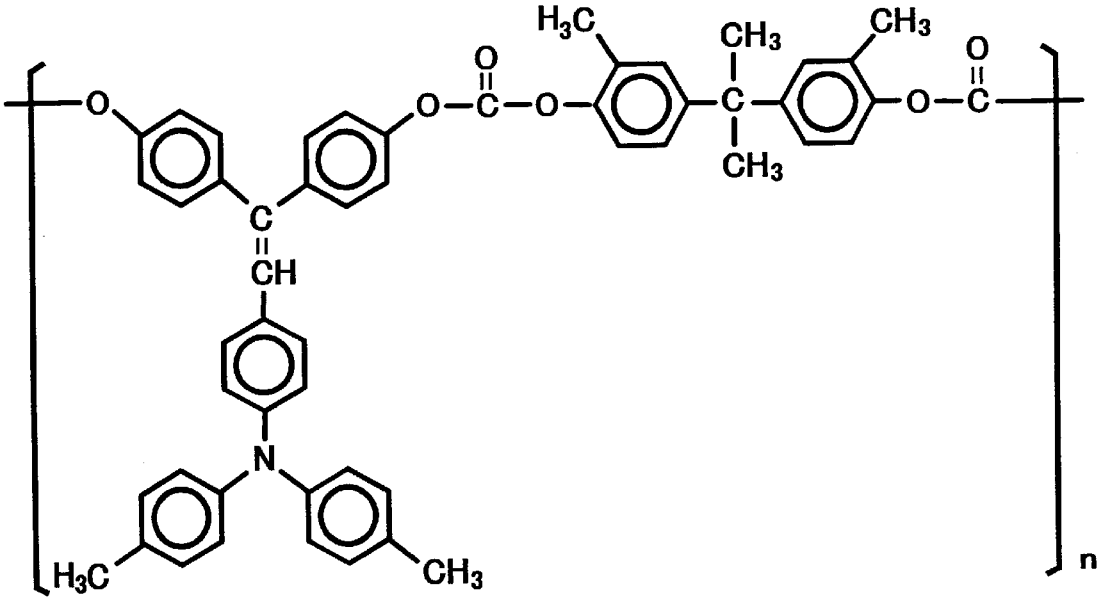

The above-described photosensitive member may be made of a variety of materials as illustrated in FIGS. 20, 21 and 22. The first example of the photosensitive member is now described. An undercoat layer of 3.5 $\mu$m, a charge generating layer of 0.2 $\mu$m, a charge transfer layer of 20 $\mu$m, and a protective layer of 5 $\mu$m are formed in lamination on an aluminum drum having a diameter of 30 mm by sequentially coating and drying coating solutions for the undercoat layer, the charge generating layer, the charge transfer layer, and the protective layer, each of which are made of the following composition. Thus, the photosensitive members 4Y, 4M, 4C and 4K to be employed in the present invention may be obtained. The undercoat layer, the charge generating layer, and the charge transfer layer may be formed by the dip coating method, and the protective layer, by the spray method.

The following coating solution may be employed for the undercoat layer. Alkyd resin (BECCOSOL 1307-60-EL: Dainihon Ink Chemicals, Inc.): 6 wt. parts. Melamine resin (SUPERBECCAMINE G-821-60: Dainihon Ink Chemicals, Inc.): 4 wt. parts. Titanium oxide (CR-EL: Ishihara Sangyo Kaisha Ltd.): 40 wt. parts. Methylethyl ketone: 200 wt. parts.

The following coating solution may be employed for the charge generating layer. Charge generating material having a structure of the Chemical Formula illustrated in FIG. 20: 3 wt. parts. Polyvinyl acetal (ESLEX BX-1: Sekisui Chemical Co., Ltd.): 1 wt. part. Methylethyl ketone: 100 wt. parts.

The following coating solution may be employed for charge transfer layer. Z-type polycarbonate (Teijin Limited;

PANLITE TS-2050): 1 wt. part. Low-molecular charge transfer material having a structure of the following chemical Formula illustrated in FIG. 21: 8 wt. parts. Tetrahydrofuran: 100 wt. parts. Silicone oil (KF50-100CS: The Shin-Etsu Chemical Co., Ltd.): 1 wt. part.

The following coating solution may be employed for the protective layer. Z-type polycarbonate (Teijin Limited: PANLITE TS-2050): 10 wt. parts. Low-molecular charge transfer material having a structure of the following chemical formula as illustrated FIG. 21: 7 wt. parts. Tetrahydrofuran: 100 wt. parts. Cyclohexane: 400 wt. parts. α-alumina (SUMICORUNDUM AA-03: Sumitomo Chemical Co., Ltd.): 5 wt. parts. Intrinsic resistance reducing agent (BYK-P104: Bick Chemie Co.): 0.05 wt. parts.

The second example of the photosensitive member may now be described. A photosensitive member was prepared with the same configuration as in the above-described first example other than that the coating solution for the protective layer in the first example of the photosensitive member is replaced by the following composition. In this example, titanium oxide may be used in place of α-alumina.

The following coating solution may be employed for the protective layer. Z-type polycarbonate (Teijin Limited; PANLITE TS-2050): 10 wt. parts. Low-molecular charge transfer material having a structure of the following chemical formula illustrated in FIG. 21: 7 wt. parts. Tetrahydrofuran: 100 wt. parts. Cyclohexanone: 400 wt. parts. Titanium oxide (Ishihara Sangyo Kaisha Ltd.): 5 wt. parts. Intrinsic resistance reducing agent (BYK-P104: Bick Chemie Co.): 0.05 wt. parts.

The third example of the photosensitive member may now be described. A photosensitive member was prepared with the same configuration as in the first example other than that the coating solution for a protective layer in the first example is replaced by the following composition. Silica may be used in this Example in place of α-alumina.

The following coating solution may be employed for the protective layer. Z-type polycarbonate (Teijin Limited: PANLITE TS-2050): 10 wt. parts. Low-molecular charge transfer material having a structure of the following chemical formula illustrated in FIG. 21: 7 wt. parts. Tetrahydrofuran: 100 wt. parts. Cyclohydrofuran: 400 wt. parts. Silica (The ShinEtsu Silicone Co., Ltd.): 5 wt. parts. Intrinsic resistance reducing agent (BYK-P104: Bick Chemie Co.): 0.05 wt. parts.

The fourth example of the photosensitive member may now be described. A photosensitive member was prepared with the same configuration as in the first example other than that the coating solution for protective layer in the first example is replaced by the following composition. In this example, Z-type polycarbonate may not be used, but a high molecular charge transfer material may be used in place of the low-molecular charge transfer material, and silica, in place of α-alumina.

The following coating solution may be employed for the protective layer. Low-molecular charge transfer material having a structure of the following chemical formula as illustrated in FIG. 22: 18 wt. parts. Tetrahydrofuran: 100 wt. parts. Cyclohexanone: 400 wt. parts. Silica (The Shin-Etsu Silicone Co., Ltd.): 5 wt. parts. Intrinsic resistance reducing agent (Bick Chemie Co.): 0.05 wt. parts.

The fifth example of the photosensitive member may now be described. A photosensitive member was prepared with the same configuration as in the first example other than that the charge transfer layer includes a thickness of 25 μm and no protective layer is provided.

The mechanisms and processes set forth in the present invention may be implemented using one or more conventional general purpose microprocessors and/or signal processors programmed according to the teachings in the present specification as will be appreciated by those skilled in the relevant arts. Appropriate software coding can readily be prepared by skilled programmers based on the teachings of the present disclosure, as will also be apparent to those skilled in the relevant arts. However, as will be readily apparent to those skilled in the art, the present invention also may be implemented by the preparation of application-specific integrated circuits by interconnecting an appropriate network of conventional component circuits or by a combination thereof with one or more conventional general purpose microprocessors and/or signal processors programmed accordingly. The present invention thus also includes a computer-based product which may be hosted on a storage medium and include, but is not limited to, any type of disk including floppy disks, optical disks, CD-ROMs, magnet-optical disks, ROMs, RAMs, EPROMs, EEPROMs, flash memory, magnetic or optical cards, or any type of media suitable for storing electronic instructions.

Numerous additional modifications and variations of the present invention are possible in light of the above teachings. It is therefore to be understood that within the scope of the appended claims, the present invention may be practiced otherwise than as specifically described herein.

What is claimed as new and desired to be secured by Letter Patent of the United States is:

1. An image forming apparatus, comprising:

an image carrier configured to include a coat portion configured to form a photosensitive layer and a pair of non-coat portions at both sides thereof, said non-coat portion being formed of a material harder than said coat portion;

a charge member configured to charge the coat-portion; and a gap control member configured to contact with a non-charged area of the coat portion;

wherein said charge member is brought into contact with a surface of the image carrier via the gap control member to form a prescribed gap between the charge member and the surface of the image carrier along with an effective charge width of the charge member.

2. The image forming apparatus according to claim 1, wherein said cleaning member is brought into sliding contact with the coat portion with it cleaning width being positioned inside the gap control member.

3. The image forming apparatus according to claim 1, further comprising a transfer member configured to transfer a visible image formed on the surface of the image carrier, wherein an effective transfer width of the transfer member is narrower than the effective charge width of the charge member.

4. The image forming apparatus according to claim 3, wherein the development width of the development unit is smaller than the effective transfer width.

5. The image forming apparatus according to claim 1, further comprising a development unit configured to develop a latent image formed on the image carrier with a developer so as to form a visible image, wherein a development width of the development unit is a smaller than the effective charge width of the charge member.

6. The image forming apparatus according to claim 5 or 4, wherein said developer includes a two-component developer composed of a toner and a carrier.

7. The image forming apparatus according to claim 1, wherein said charge member includes a charge roller of a metal shaft and has an elastic portion on an outer peripheral surface between the both ends, wherein said gap control member includes a pair of tape members configured to be fixed to the both ends of the elastic portion, respectively, and wherein the area between the pair of tape members serves as the effective charge width.

8. The image forming apparatus according to claim 7, wherein said tape member is formed to have a thickness of up to about 100 $\mu$m.

9. The image forming apparatus according to claim 7 or 8, wherein said pair of tape members are wound and fixed to the circumferential surfaces of both ends of the elastic portion, respectively, in such a manner that no portion of the tape members are not present in the roller axial direction for all positions over the entire circumference and the both ends of the tape members do not overlap in the circumferential direction.

10. The image forming apparatus according to claim 9, wherein the both ends of the pair of tape members are diagonally cut in such a manner that the cut edges face each other and a prescribed space is formed between both of the cut edges.

11. The image forming apparatus according to claim 10, wherein the cut lines of both of the diagonally cut edges incline relative to the side end of the tape members substantially by 45°.

12. The image forming apparatus according to claim 7, wherein both ends of said metal shaft are respectively spaced apart from the non-coat portion of the image carrier at prescribed positions when a prescribed voltage is impressed therebetween.

13. The image forming apparatus according to claim 1, wherein said charge member includes a charge roller of the metal shaft, and wherein the metal shaft is configured to have an elastic portion on its outer periphery between the both ends thereof, and wherein said gap control member includes a pair of rollers and attached to the both ends of the metal shaft.

14. The image forming apparatus according to claim 1, further comprising an image carrier unit configured to integrally mount at least both of the image carrier and the charge member.

15. The image forming apparatus, comprising:

an image carrier configured to include a coat portion, a non-coat portion and a photosensitive layer;

a charge member configured to charge the coat portion of the image carrier;

a gap control member configured to contact the coat portion of the image carrier, and disposed for forming a gap between the charge member and the image carrier by contacting with a non-charged area; and a cleaning member configured to clean the surface of the image carrier over a prescribed cleaning width by coming into sliding contact therewith, wherein said gap control member is position within the prescribed cleaning width.

16. The image forming apparatus according to claim 15, wherein said cleaning width ranges outside an outer end of the gap control member.

17. The image forming apparatus according to claim 15, further comprising a cleaning member oscillation mechanism configured to oscillate the cleaning member in a direction perpendicular to the sliding contact direction relative to the image carrier.

18. The image forming apparatus according to claim 17, wherein displacement limits on the cleaning member are positioned outside an effective charge width.

19. The image forming apparatus according to claim 15, wherein said cleaning member includes and brings a cleaning blade into sliding contact with the coat portion of the image carrier.

20. The image forming apparatus according to claim 15, wherein said cleaning width is wider than an effective charge width.

21. An image forming apparatus, comprising:

a charge member arranged to form at least a prescribed gap between its image forming area and a non-coat portion of a surface of an image carrier; and a charge unit configured to charge a coat portion of the surface of the image carrier by impressing a voltage between the charge member and the image carrier; wherein:

the following relationship is established when the flatness of the surface of the image carrier is A, that of said charge member facing the image carrier is B, and the prescribed gap is C:

$$A+B<C.$$

22. The image forming apparatus according to claim 21, wherein said prescribed gap is formed by bringing a butt-contact member provided outside the image forming area of the charge member into contact with the surface of the image carrier.

23. The image forming apparatus according to claim 21, wherein said prescribed gap is formed by a butt-contact member arranged to be held between the charge member and the surface of the image carrier, and wherein the thickness of the butt-contact member constitutes the prescribed gap C.

24. An image forming apparatus, comprising:

a roller-shaped charge member configured to form a prescribed gap in an image forming area between the charge member and the image carrier by bringing the charge member into contact with a non-coat portion of a surface of a cylindrical image carrier via a butt-contact member arranged outside the image forming area; and a charge unit configured to charge a coat portion of the surface of the image carrier by impressing a voltage between the charge member and the image carrier;

wherein the following relationship is established when the axial straightness of the surface of the image carrier is D, that of the roller surface of the charge member is E, and the prescribed gap is C:

$$D+E<C.$$

25. The image forming apparatus according to claim 24, further comprising an image carrier unit arranged to integrally mount the image carrier and the charge member.

26. An image forming apparatus, comprising:

image bearing means for bearing an image, said image bearing means including a coat portion as a photosensitive layer and a pair of non-coat portions at both sides thereof;

charging means for charging the coat portion; and gap controlling means for contacting with a non-charged area of the coat portion;

wherein said charging means are brought into contact with a surface of the image bearing means via the gap controlling means so as to form a prescribed gap between the charging means and the surface of the image bearing means along with an effective charge width of the charging means.

* * * * *